US006315138B1

(12) United States Patent
Dyson

(10) Patent No.: US 6,315,138 B1
(45) **Date of Patent: *Nov. 13, 2001**

(54) MULTIDIRECTIONAL, SWITCHLESS OVERHEAD SUPPORT SYSTEM

(76) Inventor: Donald J. Dyson, 1975 Sorrontino Dr., Escondido, CA (US) 92025

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

This patent is subject to a terminal disclaimer.

(21) Appl. No.: 09/299,803

(22) Filed: Apr. 26, 1999

Related U.S. Application Data

(63) Continuation-in-part of application No. 09/067,079, filed on Apr. 27, 1998, now Pat. No. 5,996,823, and a continuation-in-part of application No. 09/135,380, filed on Aug. 17, 1998, now Pat. No. 6,079,578.

(51) Int. Cl.[7] ..... A61G 7/10

(52) U.S. Cl. ..... 212/336; 5/83.1; 104/89; 105/148; 105/177; 212/71; 212/270; 212/338; 482/69

(58) Field of Search ..... 212/71, 270, 271, 212/331, 332, 336, 337; 5/83.1, 85.1, 86.1; 104/89; 105/148, 177

(56) References Cited

U.S. PATENT DOCUMENTS

| | | | | |
|---|---|---|---|---|
| 332,945 | * | 12/1885 | Rice | 482/69 |
| 339,650 | * | 4/1886 | Hill | 482/69 |
| 904,119 | * | 11/1908 | Downs | 104/182 |
| 1,296,571 | * | 3/1919 | Tripp | 104/182 |
| 2,943,579 | * | 7/1960 | Geddes | 212/346 |
| 3,253,552 | * | 5/1966 | Stein | 104/94 |
| 3,780,663 | * | 12/1973 | Pettit | 104/91 |
| 3,974,776 | * | 8/1976 | Deivernoise | 104/26.2 |
| 4,243,147 | * | 1/1981 | Twitchell et al. | 5/89.1 |
| 4,401,033 | * | 8/1983 | Gerkin | 104/94 |
| 4,625,631 | * | 12/1986 | Vera | 104/182 |
| 4,627,119 | * | 12/1986 | Hachey et al. | 5/85.1 |
| 4,733,783 | * | 3/1988 | Benedict et al. | 105/177 |
| 4,752,987 | * | 6/1988 | Dreyer et al. | 104/94 |
| 4,796,765 | * | 1/1989 | Maynes | 212/271 |
| 4,911,426 | * | 3/1990 | Scales | 482/69 |
| 5,038,425 | * | 8/1991 | Merry | 5/83 |
| 5,458,550 | * | 10/1995 | Braim et al. | 482/69 |

FOREIGN PATENT DOCUMENTS

| | | | | |
|---|---|---|---|---|
| 1000322 | * | 3/1983 | (SU) | 104/182 |

* cited by examiner

*Primary Examiner*—Thomas J. Brahan
(74) *Attorney, Agent, or Firm*—John R. Ross; John R. Ross, III

(57) ABSTRACT

An overhead support system. A riding surface is located over a space and supports at least one overhead cart from which a load is supported by a tension element. A plurality of spherical elements are positioned between the riding surface and overhead cart and are attached to either the cart or the riding surface. The load can be moved horizontally in the space by applying a horizontal force to the load causing the cart to move over the riding surface while carrying the load in the horizontal direction. In preferred embodiments the riding surface is an array of spoked rimless wheels. In other preferred embodiments the riding surface is a slot track, or the riding surface may be a combination of the array and slot tracks. In other preferred embodiments a hoist assembly is used to raise and lower the load. In a preferred embodiment the hoist assembly is located below the riding surface. In another preferred embodiment, the hoist assembly is located above the riding surface. In preferred embodiments casters are mounted on the top of the riding surface to permit easy horizontal movement of the cart over the casters. In other preferred embodiments the riding surface is flat and casters are mounted on the bottom of the overhead cart.

26 Claims, 23 Drawing Sheets

30
31
35
37
38

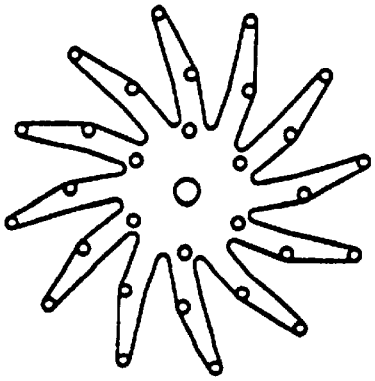
FIG. 6
FIG. 7A
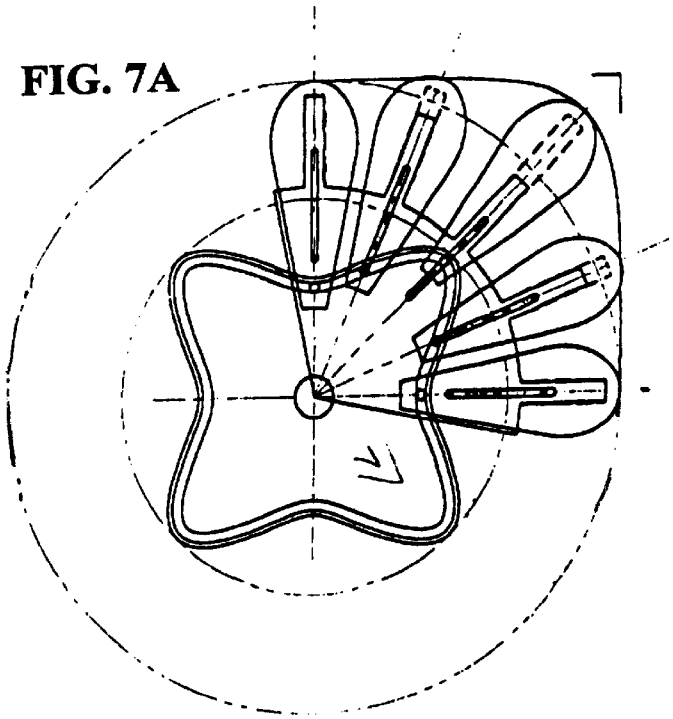
FIG. 7B
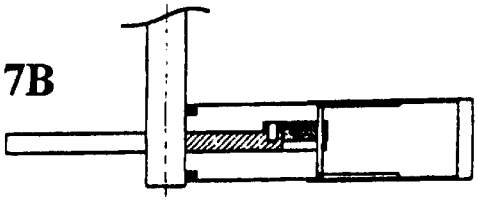

MULTIDIRECTIONAL, SWITCHLESS OVERHEAD SUPPORT SYSTEM

This application relates to support systems and in particular to overhead support systems. This is a continuation-in-part application of Ser. No. 09/067,079 filed Apr. 27, 1998 now U.S. Pat. No. 5,996,823 and Ser. No. 09/135,380 filed Aug. 17, 1998, now U.S. Pat. No. 6,079,578.

BACKGROUND OF THE INVETION

A significant portion of the population of the world has great difficulty in walking. A huge number cannot walk at all. These groups are forced to rely on attendants or mechanical devices such as crutches or wheelchairs for their ambulation. Included are those with ambulation problems due to recent hip and knee replacement surgery.

When a person is not able to walk for a period of several weeks or months, his leg muscles tend to degenerate unless physical therapy is provided. If the leg muscles degenerate, extensive physical therapy may be required to enable him to regain his ability to walk. Many people never walk again after an extensive period of relying on a wheel chair for transportation.

The prior art includes overhead support systems. These typically include an overhead track with some type of cart riding on the track with a load (which could be a person) suspended from the cart through a suspension tether. Many such systems exist in automated factories. A typical prior art overhead transport system is found by reference to U.S. Pat. No. 5,404,992. This reference discloses a suspension conveyor system comprising a conveyor device that rolls along a track rail. A major disadvantage of this design, and others like it, is that when tracks intersect, the user must select which track to take by a switching means. The switching means tends to be complicated, costly and subject to failure.

Automatic tensioning assemblies are commonly found in prior art overhead transportation systems. Generally, a tensioning assembly will maintain a set load under tension based on the load cell read-out from the torque on the tensioning assembly's drive motor. Usually, a hand held remote is used to set the load, and raise and lower the object being carried by the transportation system.

What is needed is a better overhead support system that allows for movement between intersecting tracks without switches.

SUMMARY OF THE INVENTION

The present invention provides an overhead support system. A riding surface is located over a space and supports at least one overhead cart from which a load is supported by a tension element. A plurality of spherical elements are positioned between the riding surface and overhead cart and are attached to either the cart or the riding surface. The load can be moved horizontally in the space by applying a horizontal force to the load causing the cart to move over the riding surface while carrying the load in the horizontal direction. In preferred embodiments the riding surface is an array of spoked rimless wheels. In other preferred embodiments the riding surface is a slot track, or the riding surface may be a combination of the array and slot tracks. In other preferred embodiments a hoist assembly is used to raise and lower the load. In a preferred embodiment the hoist assembly is located below the riding surface. In another preferred embodiment, the hoist assembly is located above the riding surface. In preferred embodiments casters are mounted on the top of the riding surface to permit easy horizontal movement of the cart over the casters. In other preferred embodiments the riding surface is flat and casters are mounted on the bottom of the overhead cart.

BRIEF DESCRIPTION OF THE DRAWINGS

FIG. 6 shows an alternate design of a daisy wheel.

FIGS. 7A and 7B show views of a daisy wheel with telescoping spokes.

DETAILED DESCRIPTION OF PREFERRED EMBODIMENTS

Preferred embodiments of the present invention can be described by reference to the drawings.

First Preferred Embodiment

Figure 1A:
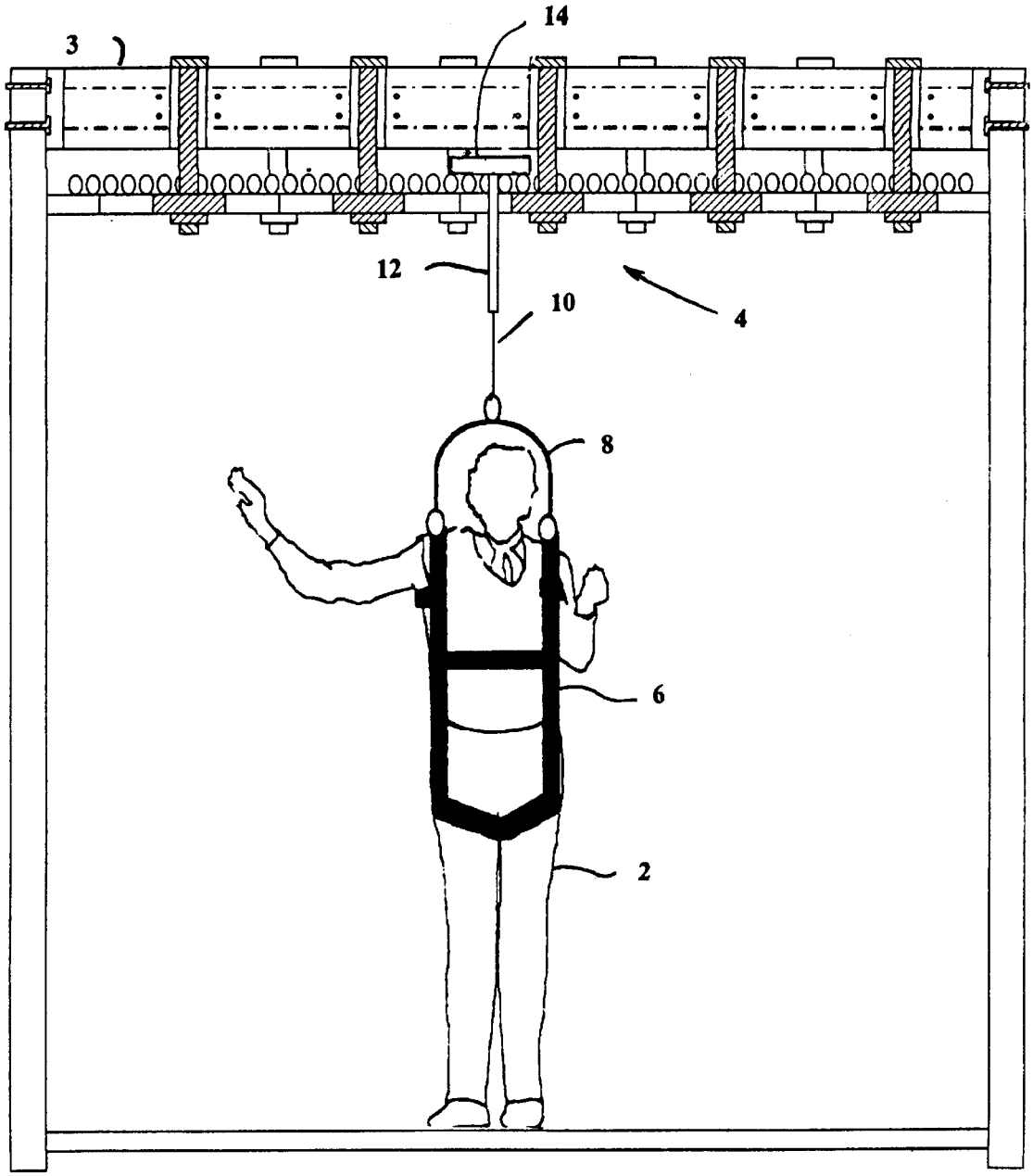
FIG. 1A shows a first preferred embodiment of the present invention.

A first preferred embodiment of the present invention can be described by reference to FIGS. 1A through 4B. As shown in FIG. 1A, a person 2 is partially supported by overhead support system 4. This system is installed near the ceiling of a small room (specifically, in this particular embodiment, about 8 feet [100.25 inches] by about 9.5 feet [114.50 inches]). The person 2 wears a parachute type harness 6 to which is attached curved support bar 8 which is in turn attached to support cable 10. Support cable 10 passes through cart tube 12, which is an integral part of overhead cart 14.

Figure 2A:
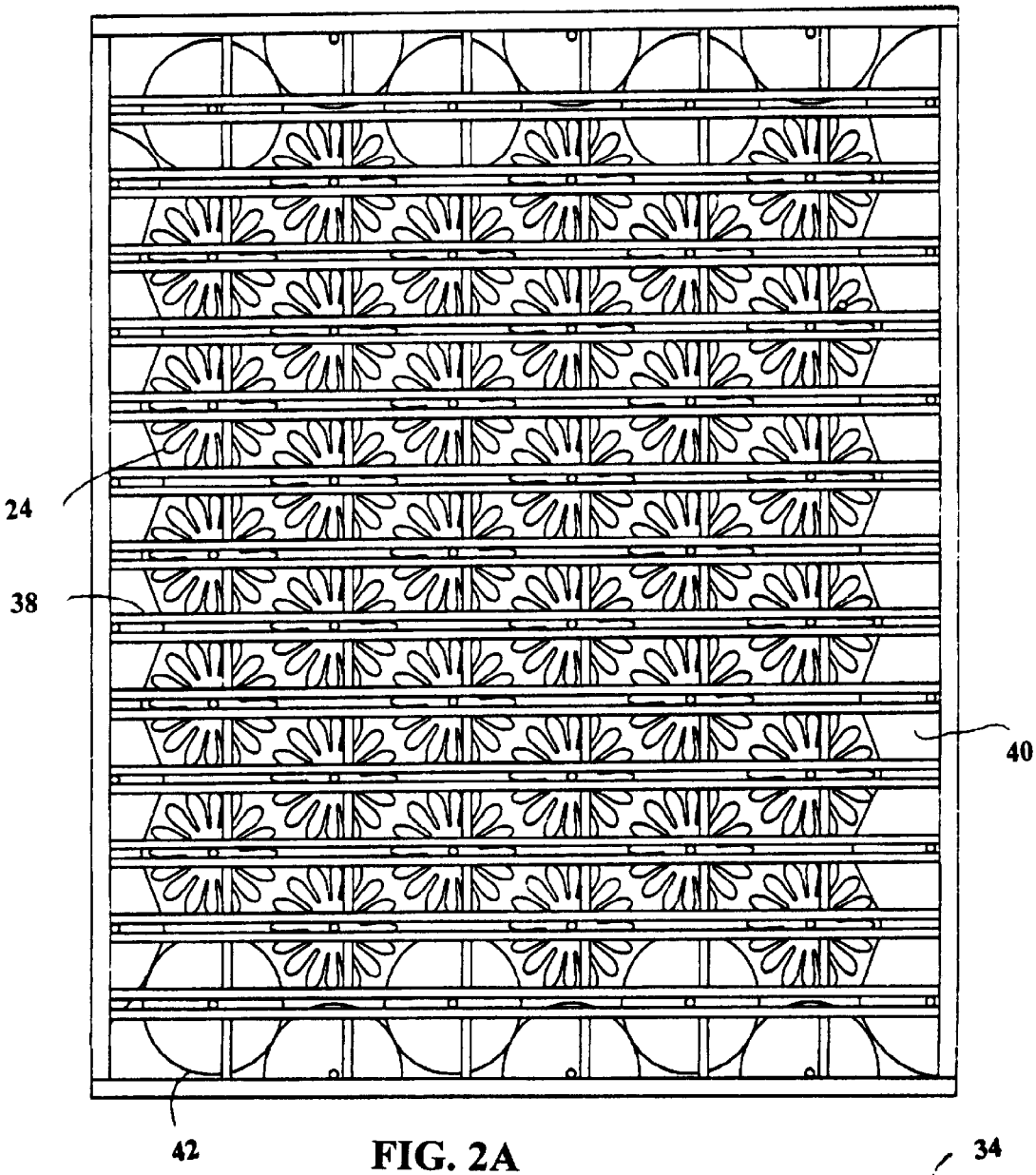
FIG. 2A shows an array of daisy wheels.
Figure 2B:
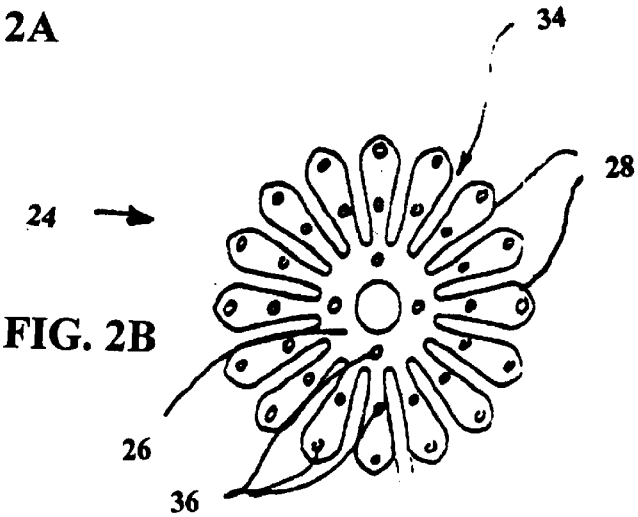
FIG. 2B is a top view of a single daisy wheel.
Figure 4B:
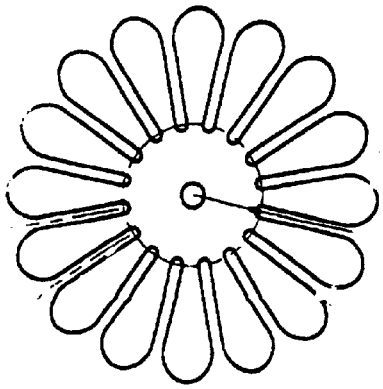
FIG. 4B is a bottom view of a daisy wheel.
Figure 4A:
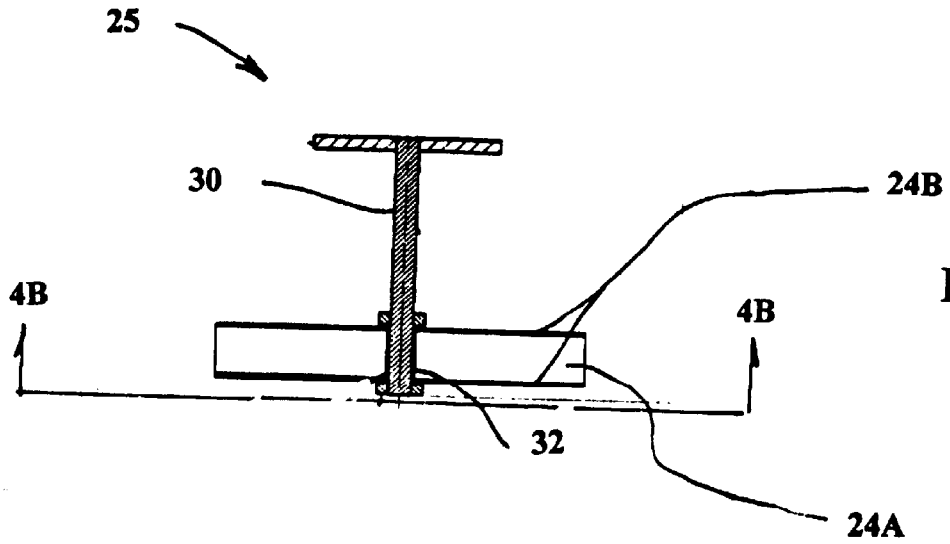
FIG. 4A shows a daisy wheel assembly.

The small room depicted in FIG. 1A and also in FIG. 2A is outfitted with thirty-three daisy wheels 24 as shown in FIGS. 2A and 2B. The thirty-three daisy wheels 24 define the riding surface upon which overhead cart 14 rides. A daisy wheel assembly is shown in FIG. 4A. A top view of one daisy wheel 24 is shown in FIG. 2B. Each daisy wheel 24 is comprised of an approximately circular inner frame 26 having a 6-inch diameter and 16 5-inch spokes 28 to produce a daisy wheel diameter of 16 inches. Each daisy wheel 24 is rotationally mounted on an 18-inch 1-inch diameter steel support rod 30. Easy rotation is provided with a bushing type bearing 32 as shown in FIG. 4A. The daisy wheel in this embodiment is comprised of a laminated structure with a 2-inch thick wood core 24A with 0.1-inch steel plates 24B on top and bottom as shown in FIG. 4. Other materials such as aluminum, steel or fiber plastic may be used. In this embodiment spokes 28 are petal shaped as shown in FIG. 2B and all 16 of them together define sixteen 2-inch slots 34 as also shown in FIG. 2B. Mounted on top of daisy wheel 24 are thirty-six casters 36, as shown in FIGS. 1A and 2B. These are inexpensive commercially available casters each having an 11/16-diameter roller ball mounted in a metal frame with the roller ball riding on three smaller ball bearings. The roller ball and the ball bearings and frame are supported by a threaded bolt which is used to attached the caster to daisy wheel 24. These casters are available from suppliers such as Acme Caster Company with offices in Paughkeepsee, N.Y.

Figures 1B, 1C, 1D, 1E:
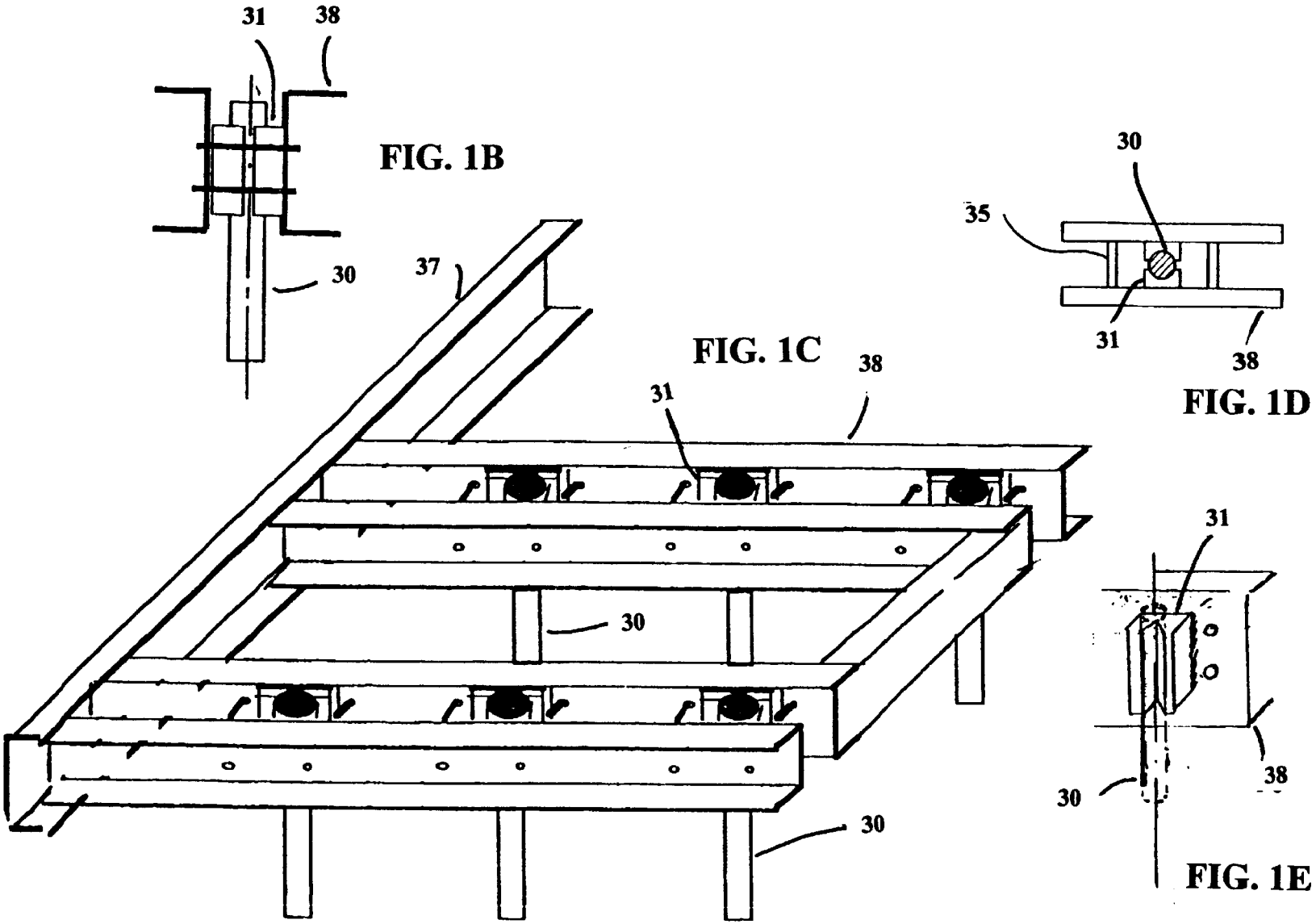
FIGS. 1B–1E shows the vertical support rod fastened to the channel shaped beams.
Figure 1F:
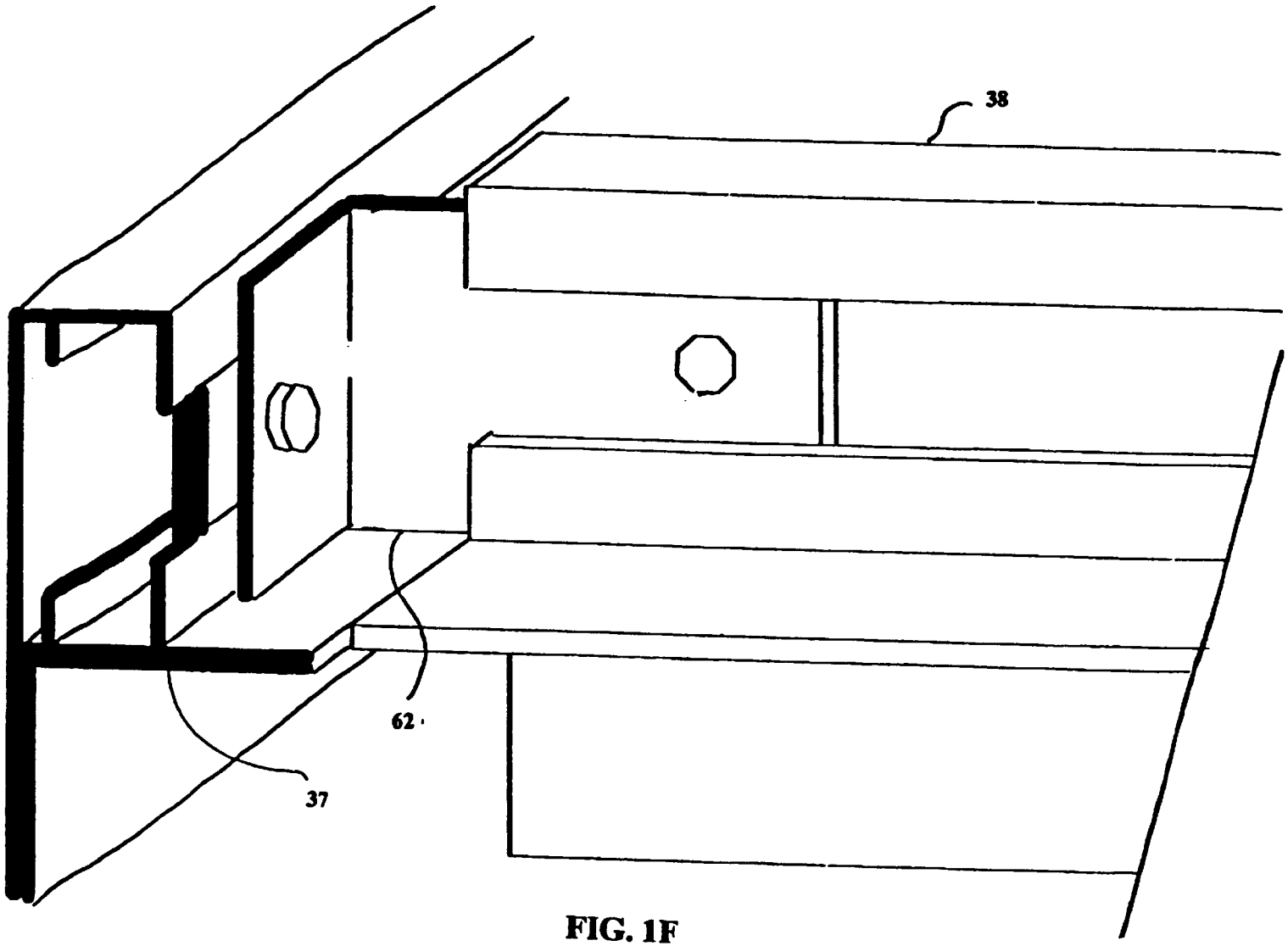
FIG. 1F shows the channel shaped beams connected to the perimeter beam.

Each 18-inch steel rod 30 is attached to one of eleven 8-foot overhead beams 38. Channel shaped beams 38 holding steel rods 30 are fitted with V-wedge blocks welded in a vertical position on the back side of horizontal beams 38 as shown in FIG. 1E and spaced to the pitch of the daisy wheels, as shown in FIG. 2A. Two channels are bolted together with bolts 35 and steel rods 30 are held by V-wedges 31 in a vertical position, as shown in FIG. 1D. V-wedge 31 spacing alternates with each adjoining beam 38 to form a triangular pitch of rods 30. Channel beams 38 (2 channels back-to-back) are supported at the edge of the room by a single perimeter channel 37 attached to wall studs, as shown in FIG. 1C. Clip angles 62 are used to attach channel shaped beams 38 to perimeter channel 37, as shown in FIG. 1F.

In this embodiment, the bottom surface of overhead cart is flat and rides on casters 36 mounted on the thirty-three daisy wheels 24 and shelves 40 and circular supports 42, as shown in FIGS. 1A and 2A.

Person 2 shown in FIG. 1A is supported by overhead support system and, with minimal stress, he can walk about in the room. Person 2 is free to go anywhere in the room except directly below the center of each daisy wheel. Preferably the overhead support system would extend at least from the persons bed to his bathroom and his eating area. This would permit him to be relatively independent. The reader should note that person 2 might sit down in a chair or lie down in a bed while continuing to be supported by overhead support system 2 provided the chair or bed is at a desired height, and more than one person could be supported by overhead support system 4. In fact in a retirement or medical facility with many patients, a large number of persons could be using the system simultaneously.

Second Preferred Embodiment

Figure 3A:
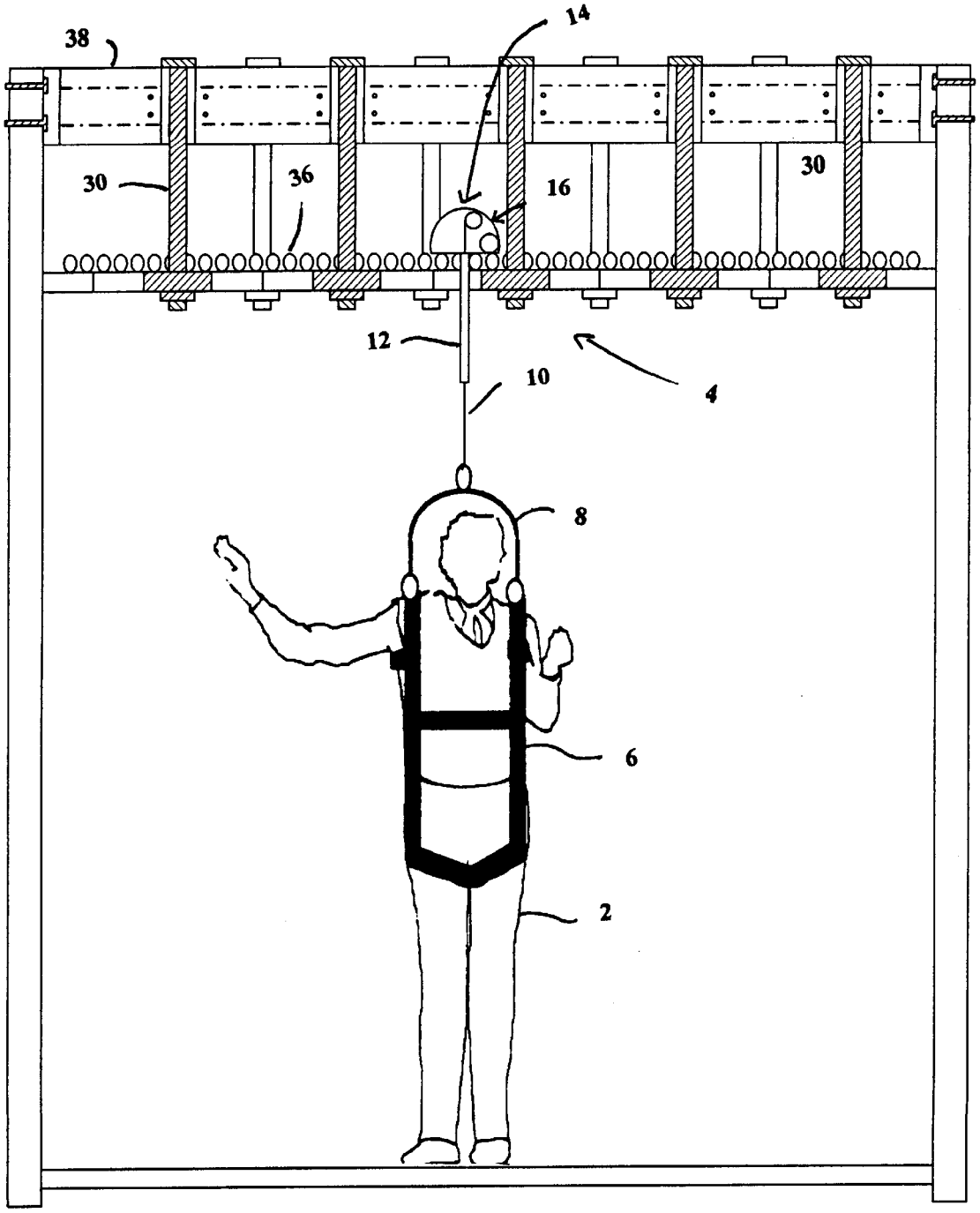
FIGS. 3A–3B shows a second preferred embodiment of the present invention.
Figure 3B:
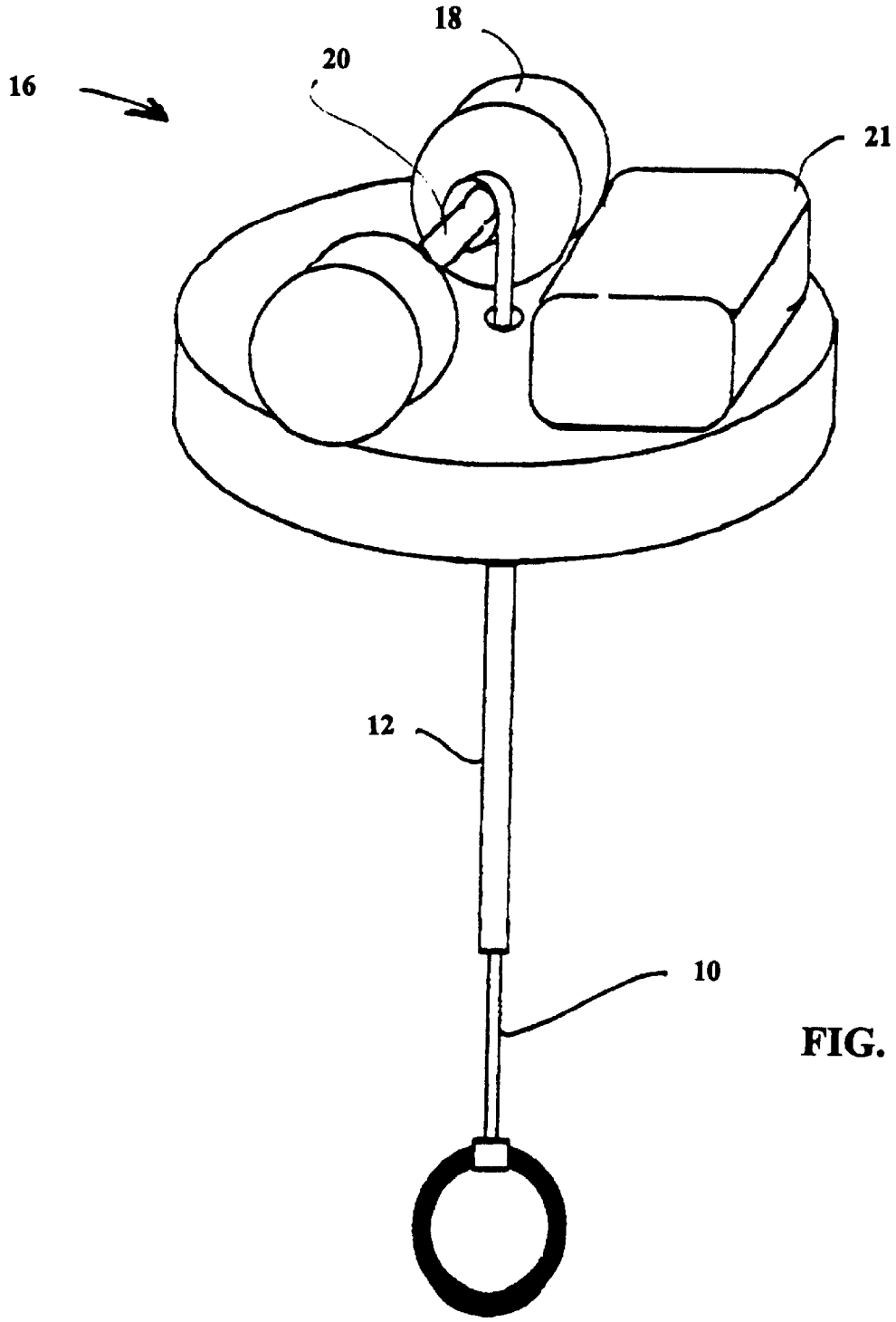

A second preferred embodiment can be described by reference to FIGS. 3A and 3B. The system is similar to the first preferred embodiment described above except this embodiment comprises a motor driven hoist assembly 16. Mounted on overhead cart 14 is hoist assembly 16, which is programmed to provide a constant tension on support cable 10. In a preferred embodiment that tension is 100 pounds (with capacity for 500 lbs.). Hoist assembly 16 is shown in more detail in FIG. 3B and comprises take-up axis 20 and drive motor 18, which is powered by rechargeable battery 21. Hoist assembly 16 is capable of raising and lowering support cable 10 from 14 inches to 72 inches.

Hoist assembly 16 is controlled by a set load based on load cell read-out from torque on drive motor 18. A hand held remote control unit is used to set load, raise or lower cable 10.

With hoist assembly 16, person 2 shown in FIG. 1A who (for example) weighs 150 pounds is now receiving 100 pounds of support from overhead transportation system 2. This person's own legs now have to support only 50 pounds. Thus, with minimal stress person 2 can walk about in the room. Person 2 is free to go anywhere in the room except directly below the center of each daisy wheel. Of course, the tension on support cable 10 can be adjusted to any value up to the weight of person 2. Recommended tensions would vary from about 90 percent of the person's weight to about 20 percent of the person's weight. Preferably the overhead support system would extend at least from the persons bed to his bathroom and his eating area. This would permit him to be relatively independent. It should be noted that person 2 might sit down in a chair or lie down in a bed while continuing to be supported by overhead support system 2. Hoist assembly 16 automatically extends support cable 10 to permit sitting or lying down. This embodiment also includes a hand-held remote control unit and a detector mounted on tube 12 with which person 2 can de-energize hoist assembly 16 or change the tension applied by it. It should be noted that more than one person could be supported by overhead support system 4. In fact in a retirement or medical facility with many patients, a large number of persons could be using the system simultaneously.

Third Preferred Embodiment

Figure 5A:
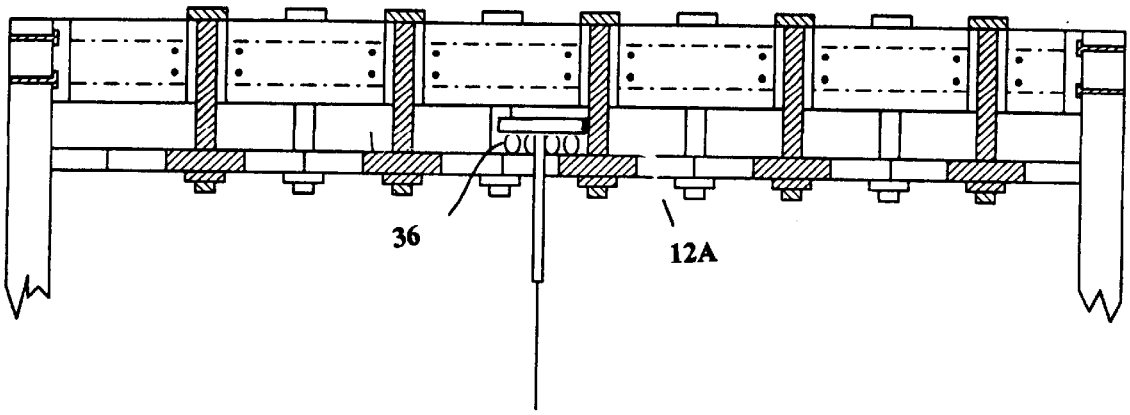
FIG. 5A shows a third preferred embodiment of the present invention without a motor driven tensioning assembly.
Figure 5B:
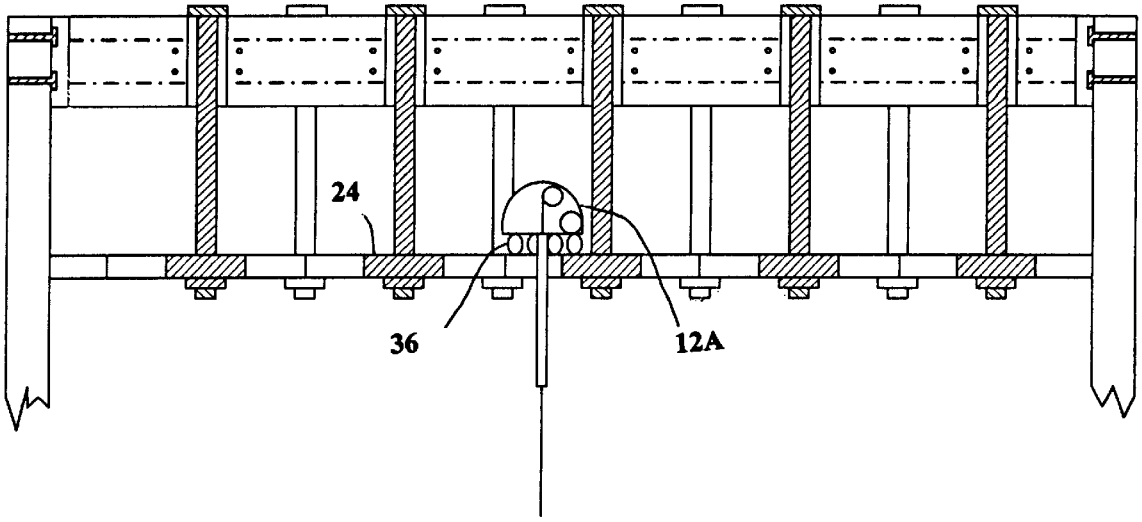
FIG. 5B shows a third preferred embodiment of the present invention with a motor driven tensioning assembly.

A third preferred embodiment of the present invention may be described by reference to FIGS. 5A and 5B. This embodiment is exactly the same as the first embodiment except in this case the Casters 36 are mounted on the bottom of cart 12A and the tops of the daisy wheels 24 the shelves 40 and circular wheels 42 are flat, with no casters 36.

Star Shaped Spoked Wheels

Another preferred embodiment, especially useful if casters 36 are mounted on the spoked wheel is to utilize a spoked wheel in the general shape of an ornamental star (or spider) as shown in FIG. 6. The points (or legs) of the star can be generally straight or angled as shown in FIG. 6. The angled shape of the legs encourages rotary motion of the spoked wheels as the cart is moved above the wheels.

Other Daisy Wheel Designs

Many modifications to the basic daisy wheel design described above could be made. Other bearing arrangements would work. For example ball bearings instead of bushing type bearings could be used. The daisy wheel part of the daisy wheel assembly could be rigidly attached to support rod 30 and a bearing arrangement mounted at the top of rod 30 could permit rotation of rod 30 along with daisy wheel 24. The spokes of daisy wheel 24 could be offset from radial directions as shown in FIG. 6. It is believed that this design would tend to guide the cart around a support when a person is headed straight toward it. The spokes of daisy wheel 24 could be designed to telescope in and out as the daisy wheel rotates in order to substantially fill the ceiling space. Such a design is shown in FIGS. 7A and 7B. This feature substantially complicates the design of the daisy wheel but would permit use of carts with smaller bottom surface areas. Applicant refers to the daisy wheel array shown in FIG. 1A as a triangular array. Other arrays are possible, such as a rectangular array. However, the rectangular array produces more open space for the cart to cross.

Design Parameters

Preferably the support system for use to support people is designed to withstand a dynamic load of at least 1000 pounds, preferably 2000 pounds. Users should be able to move through the room at speeds of at least 30 feet per minute. The Tether system should be able to lift a person from a prone position on the floor to a full standing position. The support system should be modular in design to fit rooms from 30 square feet to 200 square feet of various widths and lengths. Several people should be able to use the system simultaneously. The system should allow two persons to pass in a four-foot wide hallway. The system should be easy to install (for example) in a 200 square foot room by two people in about 4 hours. In the above embodiment the maximum deflection of the tips of the daisy wheels is estimated to be about 1/32 inch with a 300 pound load.

Other Cart Designs

Figure 8:
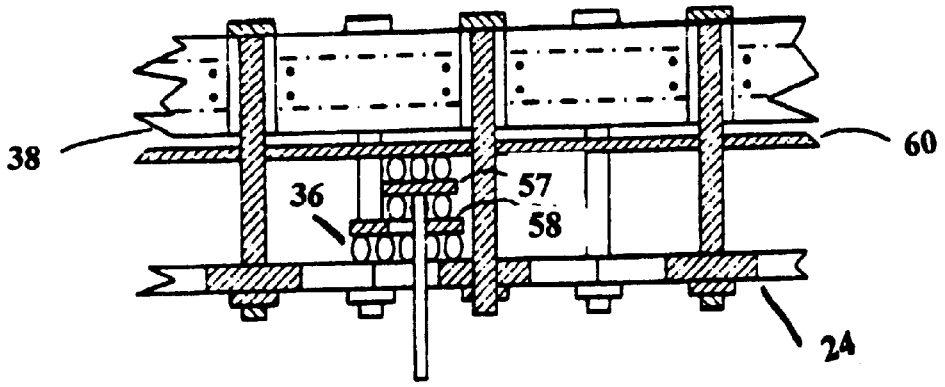
FIG. 8 shows a fourth preferred embodiment of the present invention.
Figure 9A:
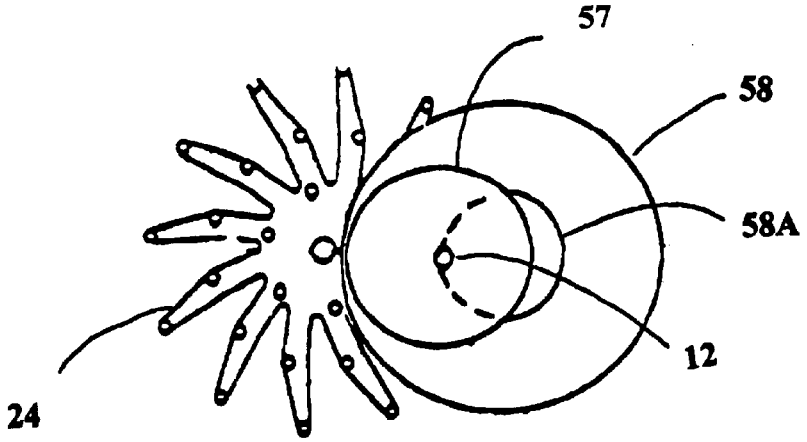
FIGS. 9A and 9B show the top cart, center hole cart and daisy wheel.
Figure 9B:
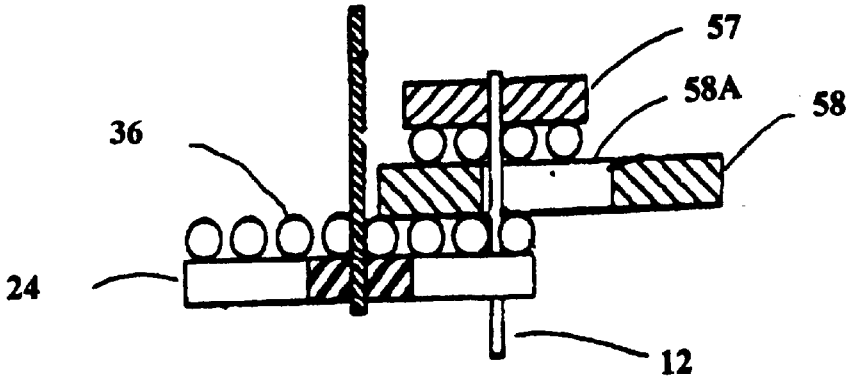

Various other cart designs are possible. For example, in some applications a hoist may not be needed or could be located below daisy wheels 24. With the hoist eliminated or located beneath the daisy wheels 24, the distance between the daisy wheels 24 and channel shaped beams 38 can be lessened, or a double layered cart as shown in FIG. 8 could be used. In FIG. 8, casters 36 roll in-between daisy wheels 24, center hole cart 58 and top cart 57. Also, casters 36 roll between top cart 57 and false ceiling 60 for greater stability. FIGS. 9A and 9B further illustrate the function of top cart 57 and center hole cart 58 with the hoist part of hoist assembly 16 eliminated from above daisy wheel 24. Cart tube 12 is rigidly connected to top cart 57. Casters 36 are fastened to the bottom of top cart 57 and roll on center hole cart 58. Because center hole cart 58 contains a hole 58A, top cart 57 is able to achieve greater motion along center hole cart 58 than it could if there was no hole 58A. Center hole cart 58 rides on casters 36 attached to the topside of daisy wheel 24.

Figure 10:
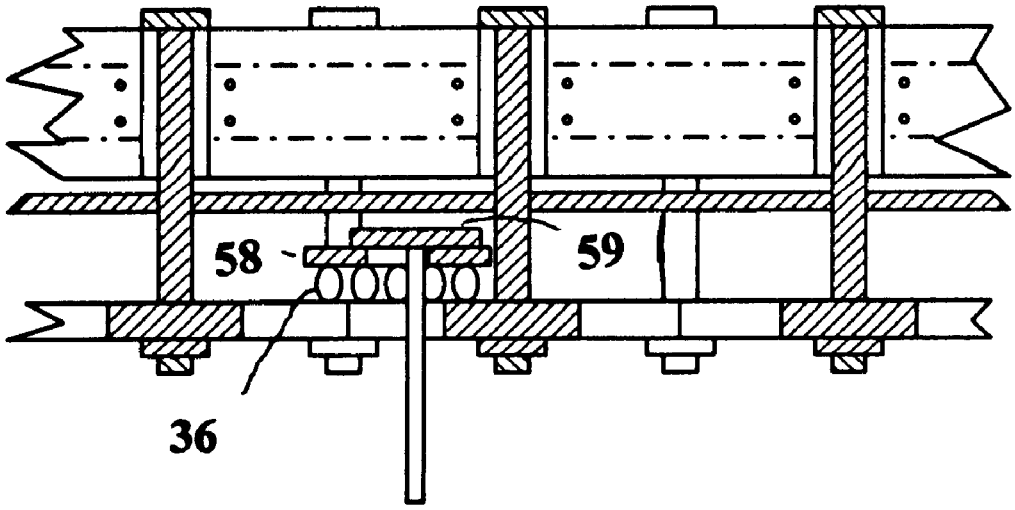
FIG. 10 shows a fifth preferred embodiment of the present invention.

FIG. 10 shows center hole cart 58 with casters 36 attached to its bottom side. However, there are no casters in-between center hole cart 58 and top cart 59. A further modification of this design would be to remove casters 36 from in-between daisy wheel 24 and center hole cart 58. For this embodiment low friction material and/or appropriate lubricants could be utilized.

In other embodiments, the carts can be equipped with a prior art track attachment to permit a person using the system to exit a room equipped with the present invention and proceed to a room, hallway or stairway equipped with an overhead track system. The track system could be motorized, especially for stairways. For multi-story buildings an elevator can be equipped with the spoked rimless wheels in the ceiling of the elevator to permit persons to move from one floor to a higher or lower floor.

Slot Track Embodiment

Previous discussion has focused the utilization of the present invention in a room with an array of daisy wheels 24, as shown in FIG. 2A. In other words, daisy wheels 24 provided the riding surface for overhead cart 14. However, it is also possible, and in many cases desirable, to have a slot track as the riding surface. The slot track embodiment is described by reference to FIGS. 11A through 15. The advantage of using a slot track over a prior art track is that prior art tracks require the user to operate a switching means in order select which track to take whenever tracks intersect. The switching means tends to be complicated, costly and subject to failure. Also, as previously stated, to integrate the present invention with a prior art track would require fitting the overhead carts with a prior art track attachment, which would raise both the cost and weight of the present invention.

Figure 11A:
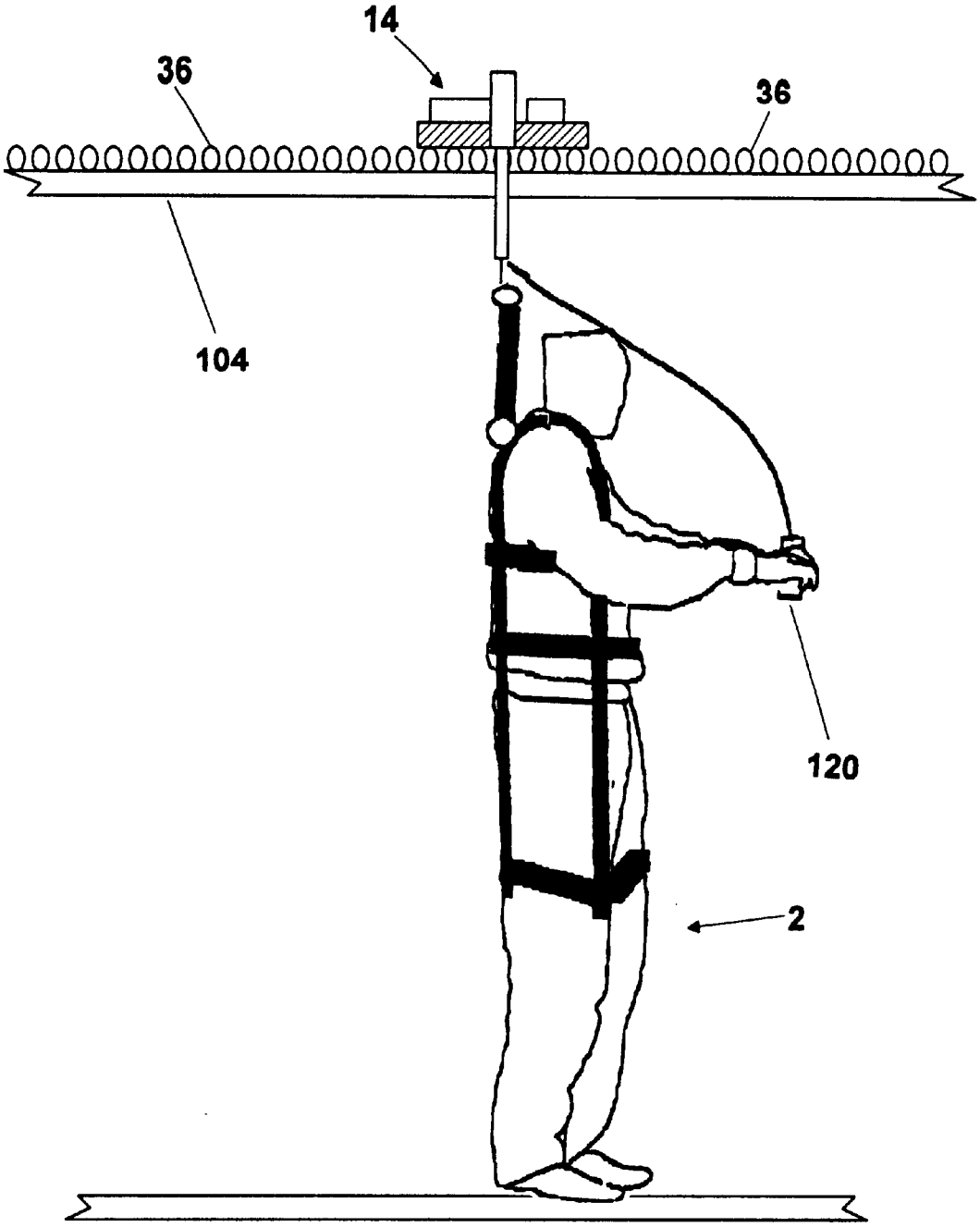
FIGS. 11A and 11B show the use of the present invention with a slot track embodiment.
Figure 11B:
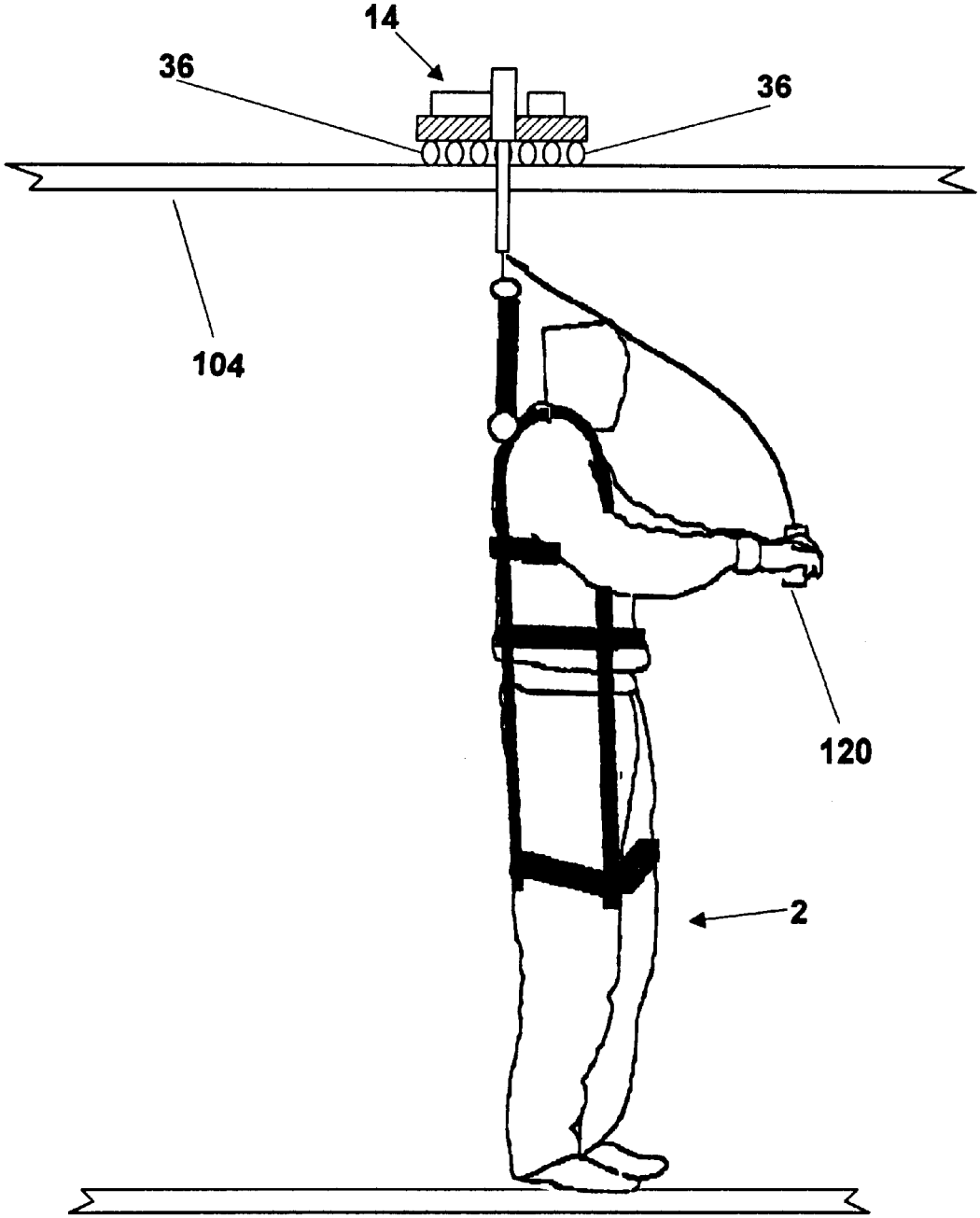
Figure 12A:
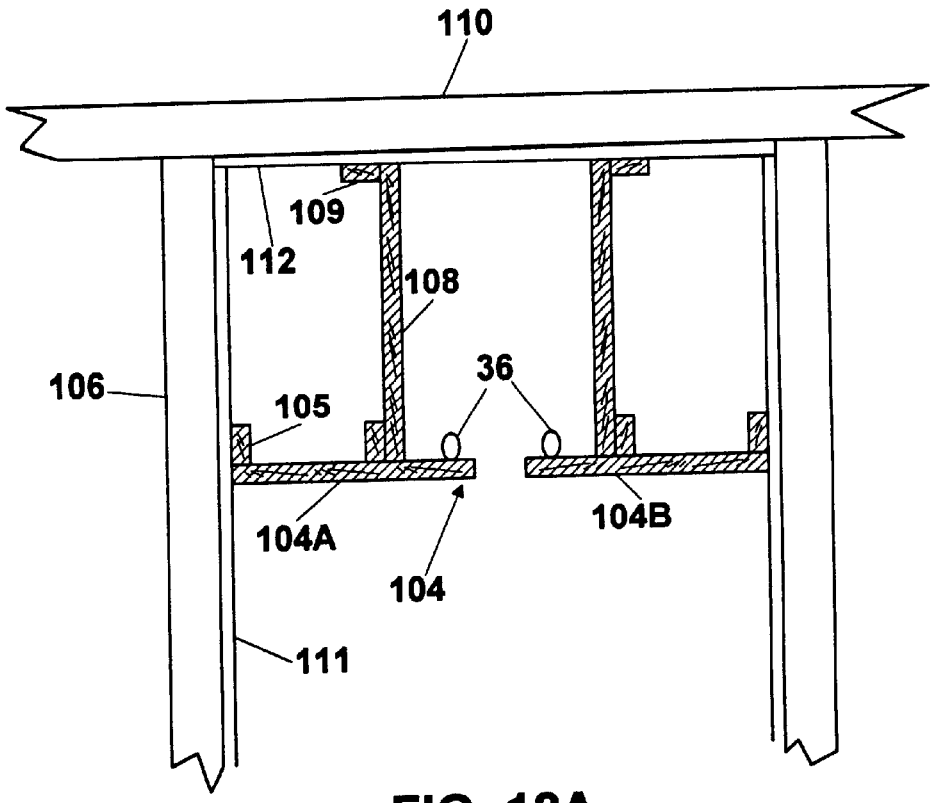
FIGS. 12A and 12B show a cross-section view of a slot track embodiment.
Figure 13A:
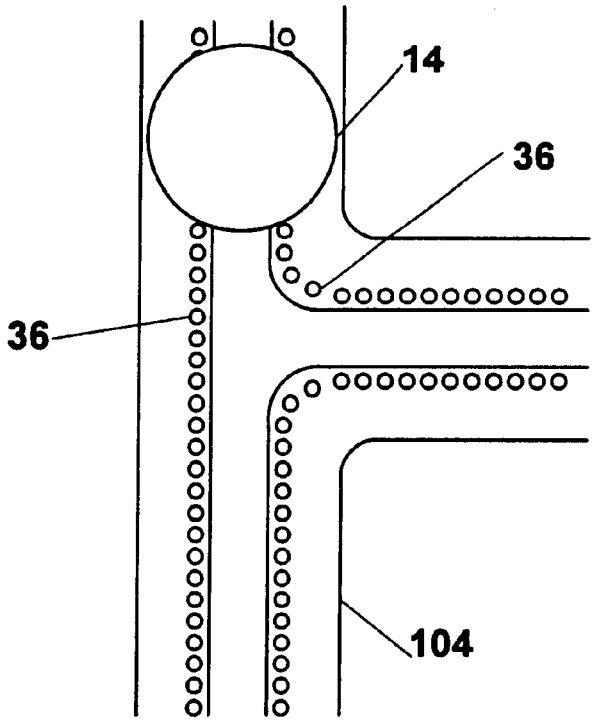
FIGS. 13A and 13B show the overhead cart on top of the slot track.

A first embodiment of the slot track version of the present invention is shown in FIG. 12A (side view) and FIG. 13A (top view). In FIG. 11A, person 2 is shown using the embodiment shown in FIGS. 12A and 13A. FIG. 11 A shows overhead cart 14 rolling on casters 36. In this embodiment, casters 36 are mounted on both sides of slot track 104, as shown in FIGS. 12A and 13A. In the preferred embodiment, casters 36 are spaced 2 inches apart.

Figure 12B:
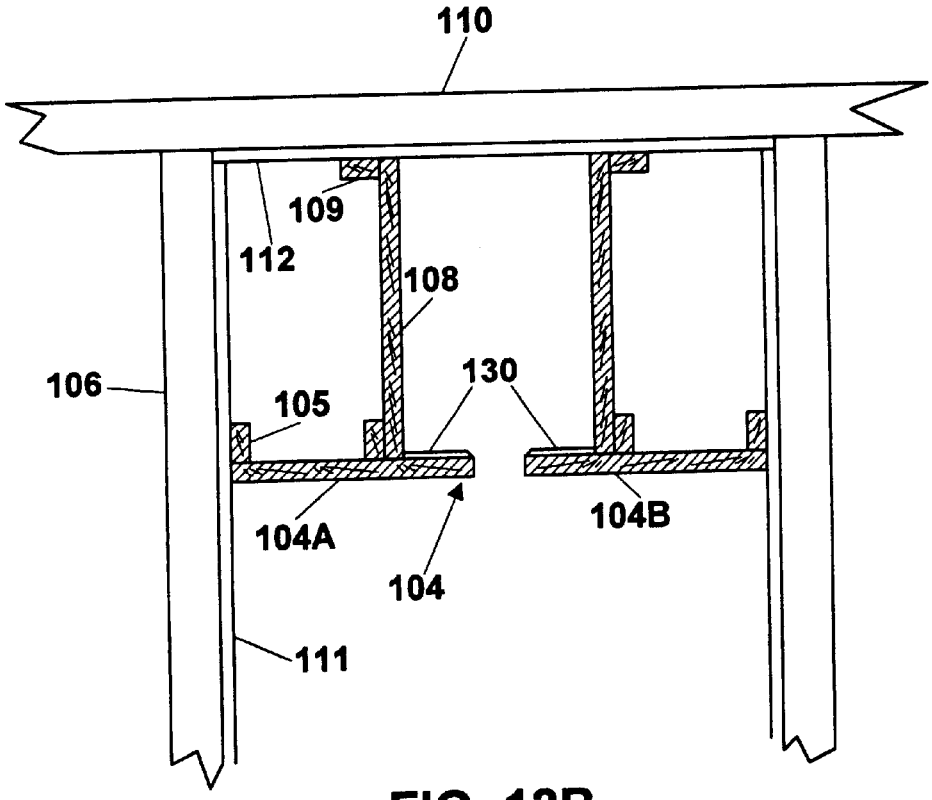

As shown in cross section view presented by FIGS. 12A and 12B, slot track 104 has a slot that is four inches wide and which is bordered one each side by plywood planks 104A and 104B that have a thickness of two inches. The length of the planks will vary depending on the length of the slot track desired. Slot track 104 is supported horizontally by 2-inch× 4-inch boards 105 rigidly attached to slot track 104 and rigidly attached to wall studs 106. Slot track 104 is supported vertically by rigid attachment to 2-inch×4-inch boards 107, which in turn are rigidly attached to track support boards 108, which are in turn rigidly attached to 2-inch×4-inch boards 109, which are in turn rigidly attached to joists 110. In the preferred embodiment, boards 105 and 109 are rigidly attached to wall studs 106 and joists 110, respectively, by screws which can easily be screwed through dry wall 111 and ceiling 112.

Figure 15:
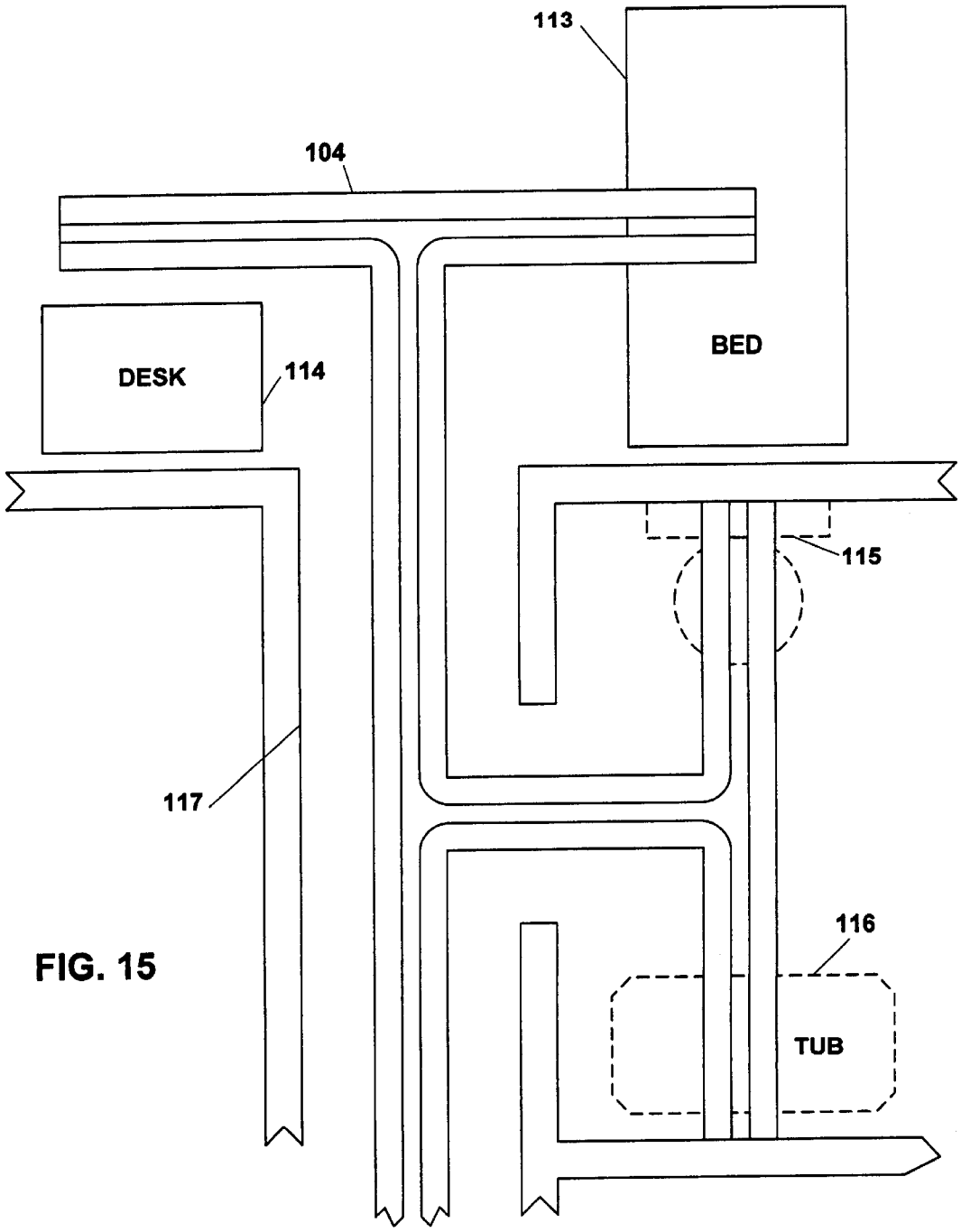
FIG. 15 shows a slot track installed to reach different locations in a residence.

The main advantage of slot track 104 is made clear by reference to FIG. 13A and FIG. 15. FIG. 13A shows casters 36 mounted on the edge of slot track 104. Overhead cart 14 can proceed straight or turn, depending on the will of the user. Response is instantaneous and no switching mechanisms are required, unlike prior art systems. FIG. 15 better illustrates how the present embodiment could be utilized in a residence. Slot track 14 could be installed to allow movement between bed 113, desk 114, toilet 115, tub 116 and down the hallway 117. As previously stated, no switching mechanisms would be required at slot track intersections.

Slot Track Embodiment with Casters Mounted on Overhead Cart

Figure 13B:
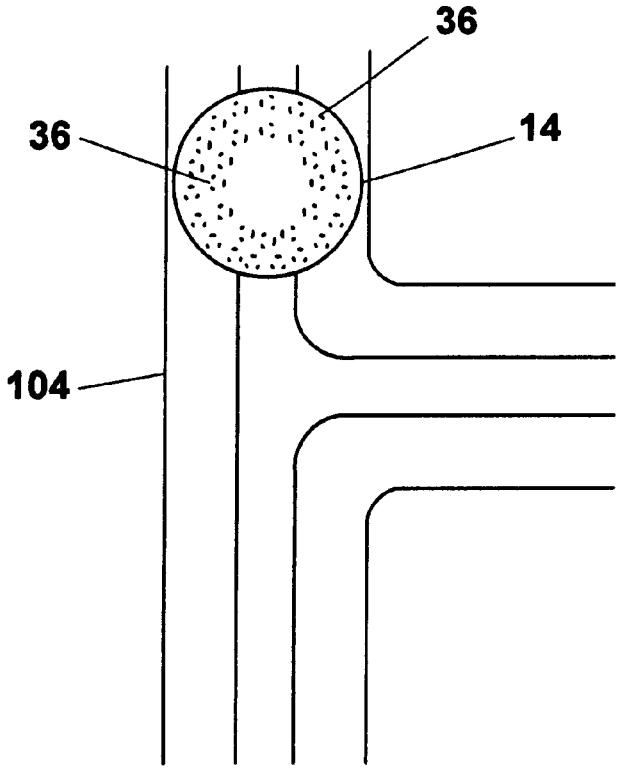

The slot track embodiment described above shows casters 36 mounted on slot track 104 and spaced 2 inches apart. However, it is also possible to mount casters 36 on overhead cart 14 and so that casters 36 roll on a smooth slot track, as shown in FIGS. 11B, 12B and 13B. The obvious advantage of this embodiment is that fewer casters are necessary and consequently, there is a tremendous financial savings.

Noise Dampening

Figure 14A:
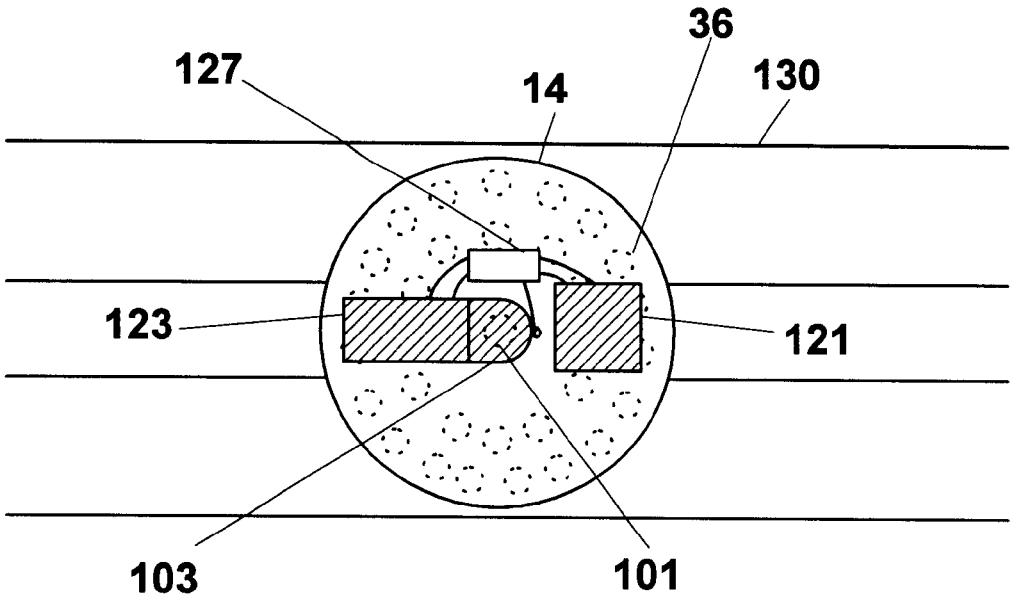
FIGS. 14A and 14B show an alternate hoist assembly.
Figure 14B:
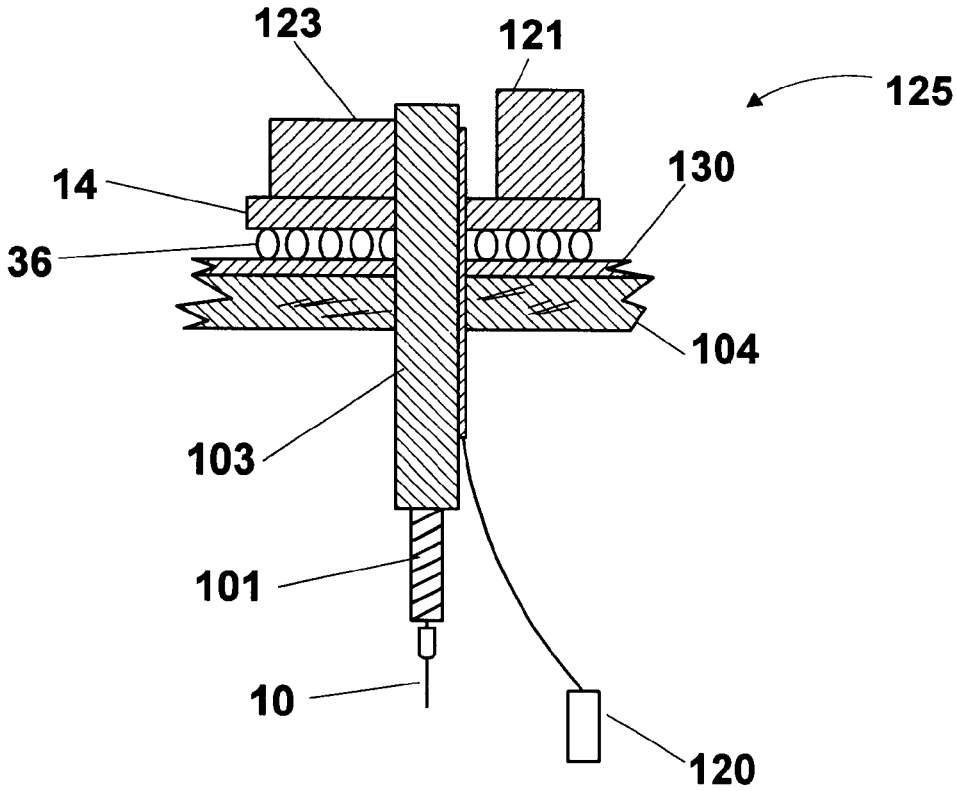

As overhead cart 14 is moved, casters 36 roll. Unfortunately, the rolling can be very noisy. It is, however, possible to dampen this unpleasant sound. Noise abatement material 130 can be placed in-between casters 36 and the opposing surface. For example, as shown in FIGS. 12B and 14B noise abatement material 130 is glued to the top of slot track 104. It would also be possible to glue noise abatement material to the tops of daisy wheels 24. Conversely, it is possible to glue noise abatement material 130 to the bottom of overhead cart 14 in embodiments that have casters 36 attached to the sides of slot track 104 or the tops of daisy wheels 24. In a preferred embodiment, noise abatement material is made from polyurethane, part no. 8716K82. It is supplied by McMaster-Carr Supply Company with offices in Sante Fe Springs, Calif.

Combining the Slot Track Riding Surface with the Daisy Wheel Riding Surface Another preferred embodiment is to combine in a single facility a slot track embodiment with an array of daisy wheels embodiment. For example, a residence could have a slot track configuration as described in FIG. 15 that takes the user through the hallway and selected rooms. Slot track 104 could also then take the user to a different room configured, such as the room shown in FIG. 2A, with an array of daisy wheels. An example of a room that might be set up with the daisy wheel array, would be a living room where the ability to move in random directions is more important than a hallway or a bathroom.

Using Rolling Wheel Assemblies at Slot Track Straight Sections

Figure 18:
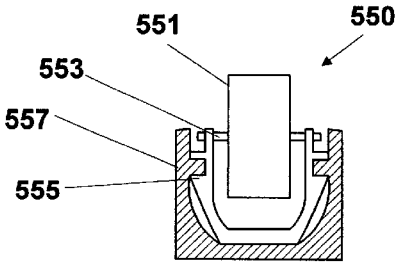
FIGS. 18 and 19 show a rolling wheel assembly.
Figure 19:
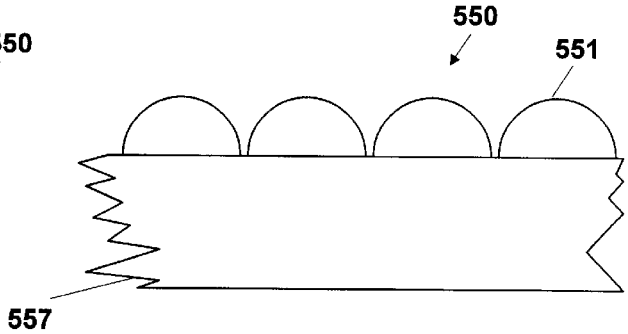

FIG. 18 shows a front view of rolling wheel assembly 550. Wheel 551 rotates on axis 553, which is supported by bracket 555. Bracket 555 slides into assembly track 557. As more brackets 555 are slid onto assembly track 557, a series of wheels 551 is formed, as shown in FIG. 19. Wheels 551 and brackets 555 are sold together as one unit and are available from McMaster/Carr Supply Co., in Los Angeles, Calif. (part no. 5897K41). Assembly track 557 is also available from McMaster/Carr Supply Co. (part no. 5897K71)

Figure 20:
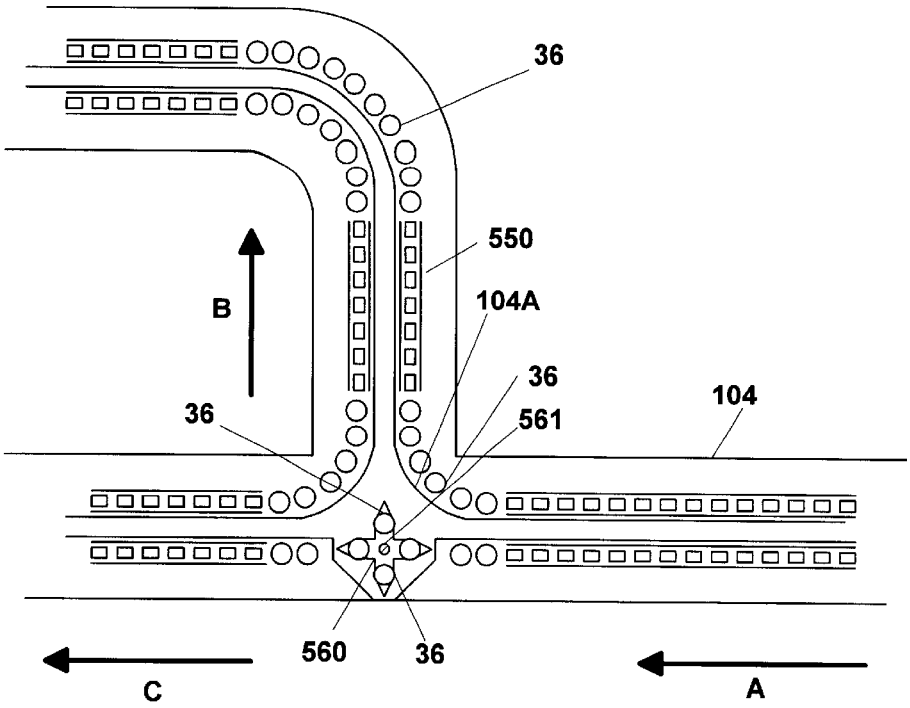
FIG. 20 shows another preferred embodiment of a slot track.

FIG. 20 shows a top view of slot track 104. In this embodiment, rolling wheel assemblies 550 are placed along the straight sections of slot track 104. Casters 36 are placed along the curved sections of slot track 104 and at where slot tracks 104 intersect. The advantages of using rolling wheel assemblies 550 at the straight sections of slot track 104 are that they are less expensive than casters 36 and that they are much quieter. It is, however, still desirable to use casters 36 at curved sections and at intersections because casters 36 allow overhead cart 14 to move more smoothly around curves and at points where there is a change of direction.

Inserting a Spoked Wheel at Slot Track Intersections

FIG. 20 shows spoked wheel 560 placed at the intersection of two slot tracks 104. Spoked wheel 560 is free to rotate around the axis formed by overhead support axis 561 If a user is traveling in a direction A and desires to change his direction to direction B at the slot track intersection, it is more natural and more desirable for him to be able to "cut the corner" rather than make a sharp ninety degree turn. Rounding the corner at slot track section 104A allows the user to "cut the corner". However, it also opens a relatively large gap in slot track 104 that, if ignored, could permit overhead cart 14 to fall through the slot in slot track 104. By placing spoked wheel 560 at the intersection, it is possible to round the corners at slot track 104 intersections. Then, if the user, coming from direction A decides to turn right and proceed in direction B, overhead cart 14 will roll on casters along slot track section 104*a* and along the caster position on top of spoked wheel 560. If the user, coming from direction A decides to proceed straight down direction C, then overhead cart 14 will be supported by the casters on slot track 104, as well as casters 36 on spoked wheel 560. Also, spoked wheel 560 will rotate counter-clockwise as overhead cart 14 makes contact.

Placing the Hoist Assembly below the Slot Track

Figure 21:
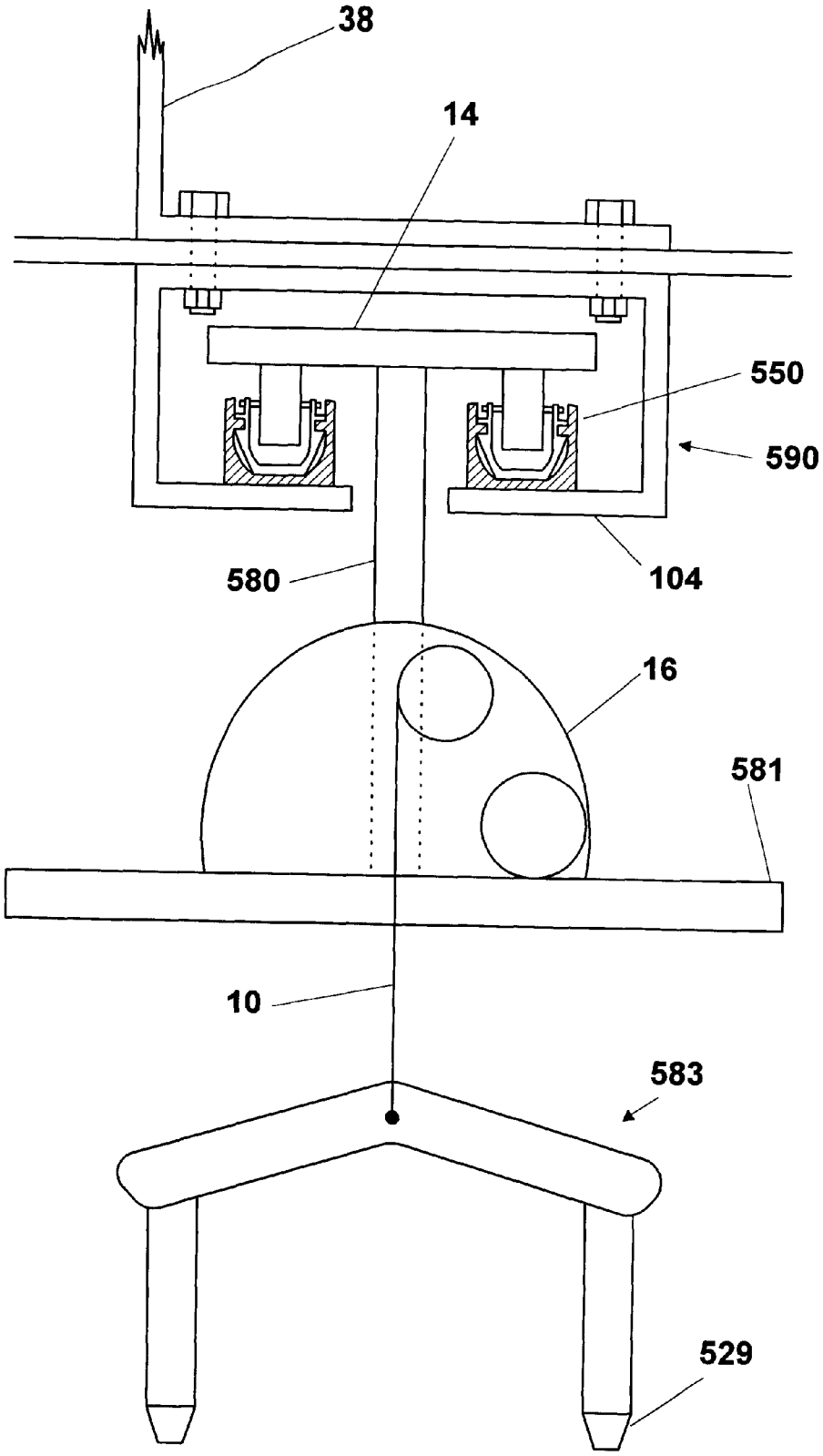
FIG. 21 shows a preferred embodiment where the hoist assembly is located below the slot track

Previous embodiments have described hoist assembly 16 as being placed above slot track 104. However, it is possible to place hoist assembly 16 below slot track 104, as shown in FIG. 21. Extrusion 590 is bolted to overhead beam 38. Preferably, extrusion 590 is ¼ inch thick single piece ceiling support extrusion (3¾ inch×6½ inch). Rolling wheel assemblies 550 are bolted to the top of slot track 104. Overhead cart 14 rolls on top of rolling wheel assemblies 550. Lower lift platform support rod 580 is rigidly connected to overhead cart 14. Lower lift platform 581 is rigidly connected to platform support rod 580. Hoist assembly 16 is positioned on top of lower lift platform 581. Hoist assembly 16 functions to raise or lower cable 10, which is connected to harness connect assembly 583.

A major advantage of placing hoist assembly 16 below slot track 104 is that extrusion 590 can be smaller than it would otherwise have to be if hoist assembly 16 was placed above slot track 104. Another advantage is that slot track 104 can be positioned closer to the ceiling. These advantages result in a more aesthetically pleasing overhead support system, one that is less expensive and also one that is easier to mount.

Other Embodiments Placing the Hoist Assembly below the Slot Track

Figure 22:
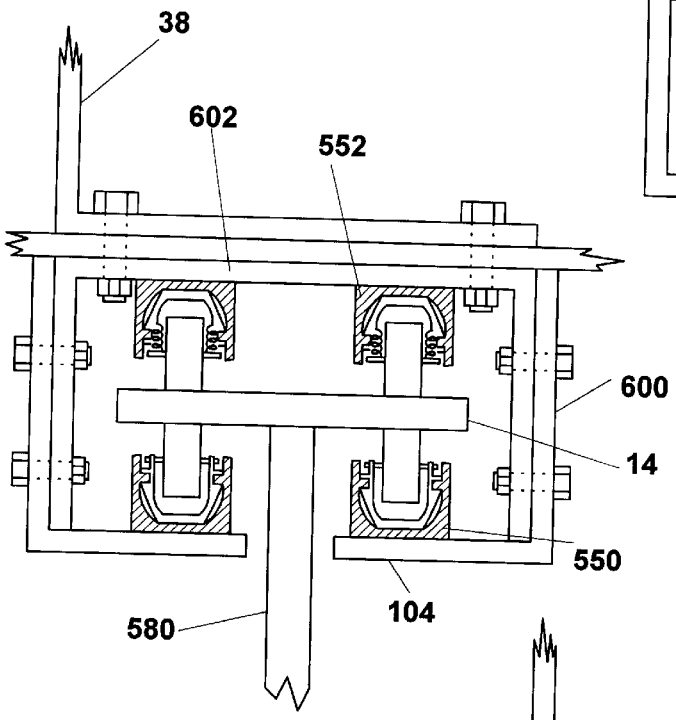
FIGS. 22–24 show other preferred embodiments where the hoist assembly is located below the slot track
Figure 23:
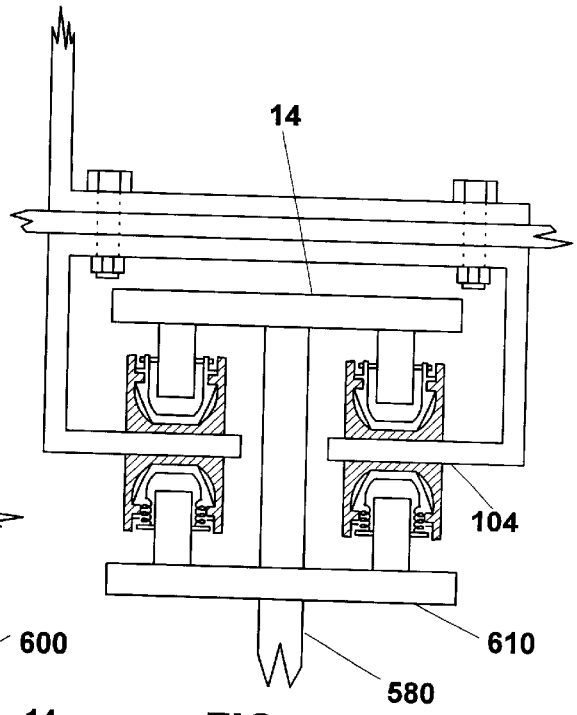
Figure 24:
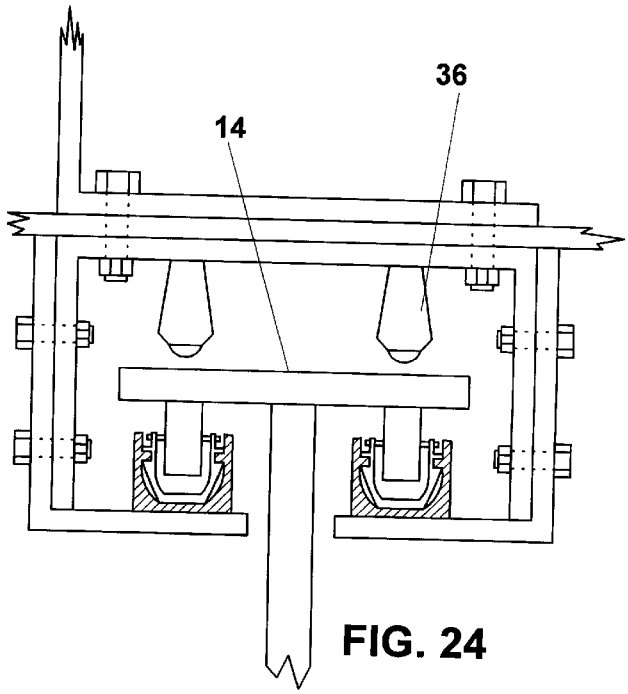

FIGS. 22–24 show alternate embodiments employing overhead cart 14 stabilizing mechanisms. As shown in FIG. 22, U-shaped metal extrusion 602 is bolted to overhead beam 38. L-shaped metal extrusions 600 are bolted to U-shaped metal extrusion 602. Rolling wheel assemblies 550 are rigidly connected to the top of slot track 104. Spring loaded rolling wheel assemblies 552 are rigidly connected to the bottom of U-shaped metal extrusion 602. Overhead cart 14 rolls on rolling wheel assemblies 500 and is stabilized (i.e., prevented from excessive tilting) by spring-loaded rolling wheel assemblies 552.

FIG. 23 shows lower cart stabilizer platform 610 rigidly connected to lower lift platform support rod 580. Overhead cart 14 rolls on rolling wheel assemblies 500 and is stabilized by spring-loaded rolling wheel assemblies 552 bearing down on lower cart stabilizer platform 610.

FIG. 24 shows an embodiment similar to that shown in FIG. 22 with the exception that casters 36 replace spring-loaded rolling wheel assemblies 552. Overhead cart 14 rolls on rolling wheel assemblies 500 and is stabilized by casters 36.

Placing the Hoist Assembly below the Daisy Wheels

Figure 25:
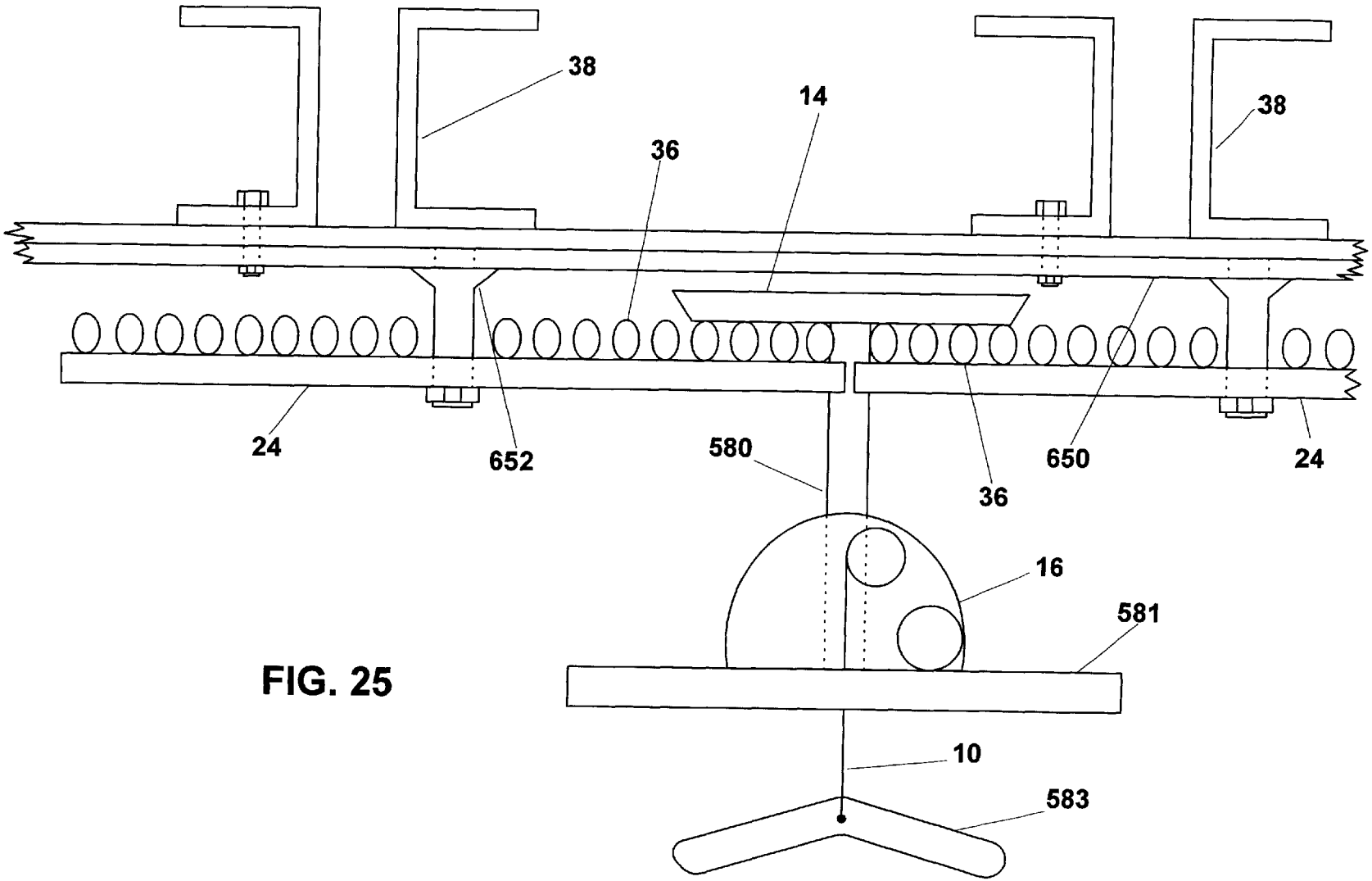
FIG. 25 shows a preferred embodiment where the hoist assembly is located below the array of daisy wheels.

FIG. 25 shows an embodiment that places hoist assembly 16 below the array of daisy wheels 24. One piece ceiling support extrusion 650 is bolted to overhead beams 38.

Preferably, ceiling support extrusion 650 is metal and is approximately ½ inch thick and 3 inches deep. Daisy wheel support posts 652 are threaded into ceiling support extrusion 650. An array of daisy wheels 24 are then bolted to daisy wheel support posts 652. Overhead cart 14 rolls on casters 36 and lower lift platform 581 supports hoist assembly 16 below the array of daisy wheels 24.

A major advantage of this embodiment is that it is much easier and to install and less expensive then the earlier described daisy wheel embodiments. Another advantage is that because daisy wheel support posts 652 are much shorter than steel support rod 30 (FIG. 3A), there is far less chance of daisy wheel 24 tilting due to the weight of the support system and the user.

Alternate Hoist Assembly

An alternate hoist assembly 125 is described by reference to FIGS. 14A and 14B. Support cable 10 is connected to geared lifting rod 101. Geared lifting rod 101 is meshed inside support tube 103. Support tube 103 is rigidly connected to cart motor 123. Cart motor 123 and power source 121 are rigidly connected to overhead cart 14. Cart motor 123 is connected to geared lifting rod 101. Hand control unit 120 is electrically connected to controller 127. Controller 127 is also electrically connected to power source 121 and cart motor 123. In the preferred embodiment, power source 121 is a 12-volt DC dry cell battery rated at 22 Amps.

FIGS. 11A and 11B show person 2 operating hand control unit 120. As shown in FIGS. 14A and 14B, hand control unit 120 provides an electrical signal to controller 127. Controller 127 directs power from power source 121 to cart motor 123. Cart motor 123 then turns geared lifting rod 101 either clockwise or counterclockwise, depending on whether person 2 desires to be raised or lowered.

In a preferred embodiment, hoist assembly 125 is available as a linear actuator, part no. 5A702. It is manufactured by Dayton Electric Manufacturing Company with offices in Viles, Ill.

Alternate Harness Assembly

Figure 17:
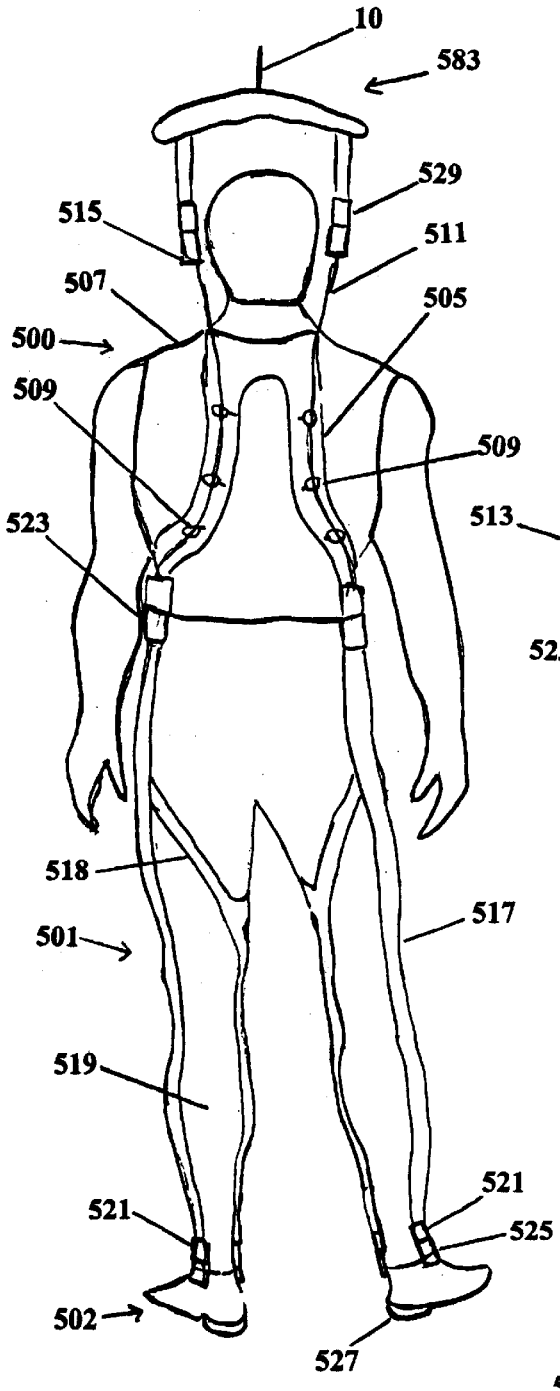
FIGS. 16 and 17 show a user wearing an alternate harness assembly.
Figure 16:
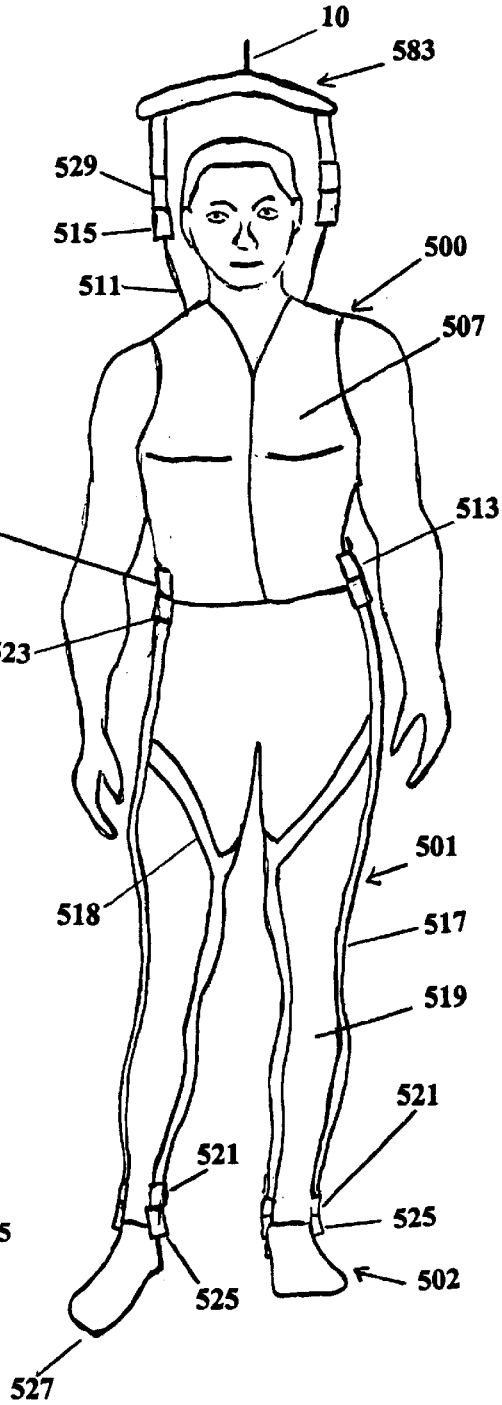

FIGS. 16–17 show an alternate harness assembly. FIG. 16 shows a front view of a user donning the alternate harness assembly and FIG. 17 shows a rear view. The alternate harness assembly comprises first section 500, second section 501 and third section 502.

For first section 500, contoured hard plastic back-piece 505 is sewn into lightweight vest 507. Metal loops 509 are then threaded into back-piece 505. Flexible metal cable 511 is then threaded through metal loops 509. Lower vest buckles 513 and upper vest buckles 515 are then attached to the ends of metal cable 511. For second section 501, straps 517 are sewn onto stretch pants 519. Lower pants buckles 521 are attached to straps 517 near the ankle end and upper pants buckles 523 are attached to straps 517 near the hip end. For third section 502, shoe buckles 525 are attached to user's shoes 527.

Utilizing the Alternate Harness Assembly

To utilize the alternate harness assembly with the present invention, the user first dons first section 500, second section 501 and third section 502. Then, he buckles upper pants buckles 523 to lower vest buckles 513. Then, he buckles shoe buckles 525 to lower pants buckles 521. Then, to attach himself to the overhead support system, the user buckles upper vest buckles 515 to support system buckles 529 of harness connect assembly 583.

As the overhead support system pulls upward on the user, the lifting force is directed down through cable 511 and through straps 517. A portion of the lifting force is then directed to thigh straps 518 and another portion of the lifting force is directed downward to shoes 527.

A major advantage of this embodiment of the alternate harness assembly is that the user is able to easily disconnect second section 501 from first section 500 by releasing lower vest buckles 513 from upper pants buckles 523. This is an extremely valuable asset to users when, for example, they need to use the bathroom. Another advantage of this harness is that the vast majority of lifting of the user occurs around the lower body. This stands in contrast to harness systems that lift primarily from the upper body. Cables 511 function to keep the user upright. Moreover, because they are directed along the user's back, they do not interfere with forward mobility, freedom of motion or movement in front of the user. Also, this harness system may easily be worn underneath ordinary clothes.

Modifications to the Alternate Harness Assembly

The alternate harness assembly was described as having first section 500, second section 501 and third section 502. However, it would be possible to modify this embodiment so as to combine second section 501 and third section 502. In other words rather than buckling lower pants buckles 521 to shoe buckles 525, an embodiment could be made so that pants 519 also include stocking feet. Straps 517 would then connect directly to the stocking feet, which preferably would be made out of a strong material such as nylon so that a portion of the user's weight could be supported. Or straps 517 could be omitted completely and upper pants buckles 523 would attach directly to pants 19. In this embodiment, pants 19 would preferrably be made out of a strong material such as nylon.

Applications

The present invention is valuable for many purposes. These include support for people with physical handicaps or people recovering from injury, joint replacements or surgery or people with a wide variety of diseases or disabling conditions such as Parkinson's, strokes or heart conditions. The invention can also be used to support animals or for the movement of equipment or toxic chemicals and it can be applied to assembly line production or meat processing. The present invention can be used by persons with no control at all over their legs. In this case the person's entire weight can be supported by the invention and he could provide the needed horizontal force by pulling or pushing on furniture or a special railing. Or if necessary the horizontal force could be provided by a hospital or nursing home attendant. Persons skilled in the art will recognize many other specific applications.

Persons skilled in this art will recognize many other changes and modifications which can be made to the present invention without departing from its spirit. Therefore, the scope of the present invention is to be determined by the appended claims and their legal equivalents.

I claim:

1. An overhead support system comprising:

A) an array of spoked rimless wheels located over a space, wherein said spoked rimless wheels are rotatably fixed in place, B) at least one overhead cart riding on said array of spoked rimless wheels, C) a tension element for supporting a load from said cart, wherein the load can be moved horizontally in random directions in the space by applying a horizontal force to the load causing said cart to move over said array of spoked rimless wheels carrying the load in the horizontal direction with at least a plurality of said spoked rimless wheels rotating to permit said tension element to pass horizontally through said array of spoked rimless wheels.

2. An overhead support system as in claim 1, wherein the load is a human being.

3. An overhead support system as in claim 2, and further comprising a harness means.

4. An overhead support system as in claim 2, and further comprising a harness assembly.

5. An overhead support system as in claim 4, wherein said harness assembly comprises:

A) a first section connected to said tension element, and

B) a second section removably connected to said first section, wherein said first section directs the tension force from said tension element around the human being to said second section, and wherein said second section supports the human being and absorbs the tension force.

6. An overhead support system as in claim 1, further comprising a hoist assembly connected to said tension element.

7. An overhead support system as in claim 6, further comprising a hand held remote, wherein said hoist assembly is controlled by said hand held remote.

8. An overhead support system as in claim 6, wherein said hoist assembly is located above said array of spoked rimless wheels.

9. An overhead support system as in claim 6, wherein said hoist assembly is located below said array of spoked rimless wheels.

10. An overhead support system as in claim 6, wherein said hoist assembly comprises:

A) a take-up axis,

B) a drive motor to rotate said take-up axis, and

C) a rechargeable battery to power said drive motor.

11. An overhead support system as in claim 10, wherein said hoist assembly is rigidly connected to said at least one overhead cart.

12. An overhead support system as in claim 1, further comprising:

A) a lower lift platform support rod extending downward from said at least one overhead cart, and B) a lower lift platform connected to said lower lift platform support rod, C) a hoist assembly rigidly connected to said lower lift platform, wherein sail hoist assembly is connected to said tension element.

13. An overhead support system as in claim 1, further comprising a plurality of spherical elements rollingly positioned between said riding surface and said overhead cart and attached to said cart or to said riding surface.

14. An overhead support system for assisting in the horizontal movement of a human being, defining a body weight, said system comprising:

A) a slot track rigidly fixed in place, wherein said slot track defines straight sections, curved sections and intersecting sections, B) at least one flat-bottomed overhead cart riding on said slot track, C) a tension element for supporting a human being from said cart, D) a plurality of rolling elements rollingly positioned between said slot track and said flat-bottomed overhead cart and attached to said slot track, wherein said plurality of rolling elements comprises a plurality of casters connected to said slot track top along said curved sections and along said intersecting sections, and further comprising a plurality of rolling wheel assemblies connected to said slot track top along said straight sections, E) a lower lift platform support rod extending downward from said flat-bottomed overhead cart, F) a lower lift platform connected to said lower lift platform support rod, and G) a motor driven hoist assembly rigidly connected to said lower lift platform, wherein said motor driven hoist assembly is connected to said tension element, wherein the human being can be moved horizontally along said slot track by a horizontal force being applied to the human being, wherein support of the body weight of the human being is distributable between the human being's feet on the floor and said overhead support system.

15. A method for moving a human being horizontally through a space, comprising the steps of:

A) placing the human being, defining a body weight, in an overhead support system, said overhead support system comprising:

1) a slot track rigidly fixed in place, wherein said slot track defines straight sections, curved sections and intersecting sections, 2) at least one flat-bottomed overhead cart riding on said slot track, 3) a tension element for supporting a human being from said flat-bottomed overhead cart, 4) a plurality of rolling elements rollingly positioned between said slot track and said flat-bottomed overhead cart and attached to said slot track, wherein said plurality of rolling elements comprises a plurality of casters connected to said slot track top along said curved sections and along said intersecting sections, and further comprising a plurality of rolling wheel assemblies connected to said slot track top along said straight sections, 5) a lower lift platform support rod extending downward from said flat-bottomed overhead cart, 6) a lower lift platform connected to said lower lift platform support rod, and 7) a motor driven hoist assembly rigidly connected to said lower lift platform, wherein said motor driven hoist assembly is connected to said tension element, and B) applying a horizontal force to the human being, wherein support of the body weight of the human being is distributable between the human being's feet on the floor and said overhead support system.

16. A method as in claim 15, wherein said step of applying a horizontal force to the human being is accomplished by an assistant pushing the human being.

17. A method as in claim 15, wherein said step of applying a horizontal force to the human being is accomplished by the human being walking.

18. An overhead support system as in claim 14, further comprising a plurality of spherical elements rollingly positioned between said slot track and said overhead cart and attached to said cart or to said slot track surface.

19. A method as in claim 15 wherein said step of applying a horizontal force to the human being is accomplished by a combination of an assistant pushing the human being and the human being walking.

20. An overhead support system as in claim 14, further comprising a hoist assembly connected to said tension element.

21. An overhead support system as in claim 20, further comprising a hand held remote, wherein said hoist assembly is controlled by said hand held remote.

22. An overhead support system as in claim 20, wherein said hoist assembly is located above said slot track.

23. An overhead support system as in claim 20, wherein said hoist assembly is located below said slot track.

24. An overhead support system as in claim 20, wherein said hoist assembly comprises:

A) a take-up axis,

B) a drive motor to rotate said take-up axis, and

C) a rechargeable battery to power said drive motor.

25. An overhead support system as in claim 24, wherein said hoist assembly is rigidly connected to said at least one overhead cart.

26. An overhead support system as in claim 14, wherein support of the weight of the human being is adjustably distributed between the floor and said overhead support system.

* * * * *